US006050471A

United States Patent [19]

Yagi

[11] Patent Number: 6,050,471

[45] Date of Patent: Apr. 18, 2000

[54] ELECTRIC STAPLER

[75] Inventor: Nobuaki Yagi, Tokyo, Japan

[73] Assignee: Max Co., Ltd., Tokyo, Japan

[21] Appl. No.: 08/956,345

[22] Filed: Oct. 23, 1997

[30] Foreign Application Priority Data

| | | | |
|---|---|---|---|
| Oct. 23, 1996 | [JP] | Japan | 8-281028 |
| Oct. 30, 1996 | [JP] | Japan | 8-288710 |
| Nov. 5, 1996 | [JP] | Japan | 8-293037 |
| Nov. 22, 1996 | [JP] | Japan | 8-312434 |
| Nov. 22, 1996 | [JP] | Japan | 8-312435 |
| Dec. 20, 1996 | [JP] | Japan | 8-341995 |
| Dec. 20, 1996 | [JP] | Japan | 8-342017 |
| Dec. 27, 1996 | [JP] | Japan | 8-349563 |

[51] Int. Cl.[7] ..... B25B 5/16; B27F 7/21

[52] U.S. Cl. ..... 227/119; 227/120; 227/131; 227/136; 227/138

[58] Field of Search ..... 227/135, 136, 227/137, 138, 131, 120, 119, 116, 114, 107, 2

[56] References Cited

U.S. PATENT DOCUMENTS

| | | | |
|---|---|---|---|
| 2,431,812 | 12/1947 | Lang | 227/136 |
| 3,009,156 | 11/1961 | Lerner | 227/136 |
| 3,708,097 | 1/1973 | Fisher | 227/136 |
| 4,588,121 | 5/1986 | Olesen | 227/136 |
| 4,716,813 | 1/1988 | Prudencio | 91/355 |
| 5,332,141 | 7/1994 | Mukoyama et al. | 227/136 |
| 5,346,114 | 9/1994 | Udagawa et al. | 227/136 |
| 5,370,295 | 12/1994 | Simonelli | 227/136 |

FOREIGN PATENT DOCUMENTS

| | | |
|---|---|---|
| 0245086 A2 | 11/1987 | European Pat. Off. . |
| 0475436 A2 | 3/1992 | European Pat. Off. . |
| 1224268 | 9/1966 | Germany . |

OTHER PUBLICATIONS

Communication from European Patent Office dated Mar. 1999, including partial International Search Report.

*Primary Examiner*—Scott A. Smith
*Attorney, Agent, or Firm*—Morgan, Lewis & Bockius LLP

[57] ABSTRACT

A driver unit for an electric stapler comprises: a frame; a driver support member vertically movably mounted on the frame; a driver having a plate-like shape, fitted to the driver member such that the driver is vertically slidable in a predetermined range with respect to the driver support member; a driver hoist mechanism for driving the driver support member, driven by a motor to lower from an upward standby position to eject a staple to clinchers arranged right below the driver; and a vertical position adjusting mechanism provided between the driver support member and the driver, for adjusting a vertical position of the driver with respect to the driver support member.

10 Claims, 24 Drawing Sheets

ELECTRIC STAPLER

BACKGROUND OF THE INVENTION

This invention relates to an electric stapler.

There are two types of electric staplers has: one using staples formed into a gantry shape beforehand; and the other having a forming plate for bending staples into a gantry shape before supplying them to a driver. In any one of these types, however, a staple magazine holder is placed above a table with which sheets of paper to be bound are loaded, and the table or the staple magazine holder is driven to move up and down. Then the paper is clamped between the staple magazine holder and the table, and a driver support member fitted with the driver is driven by a driver hoist mechanism to move from an upper standby position downward so that the staple on the staple guide of the staple magazine holder is driven into the paper.

The staple passed through the paper is caused to strike against a clincher plate on the table and is bent into shape along guide grooves formed in the clincher plate. Rotary clinchers in place of fixed type clincher plate may otherwise be provided in order to bend the staple flat by driving the clinchers to turn after the staple is driven-in. This is called a flat clinch type electric stapler.

In the aforementioned electric stapler, the driver is coupled to a motor via cams and levers and reciprocates between the upper standby position and the lowest point. However, various inconveniences occur when an error at the lowest point exceeds an allowable value due to the tolerance of each component part and assembling precision. In other words, when the lowest position is situated above a proper one, the striking force of the driver becomes insufficient, thus lowering the staple clamping performance. When the lowest position is lower than such a proper one, the drive is caused to excessively press the staple and paper and the problem is that an overload is applied to the driver driving mechanism.

Since the height of the lowest position in the driver unit of a typical conventional electric stapler is not adjustable, adjusting work such as the replacement of the driver is needed when an error in the lowest position exceeds the allowable value. The trouble and time necessary for assembling and maintenance work is a problem.

Furthermore, the position of a driver for use in striking staples has to be in agreement with the positions of clinchers for bending the legs of the staple thus ejected by the driver in a stapler. However, there are more elements in clincher-to-driver positional errors in the case of an electric stapler than those in a manual stapler because the electric stapler has a complicated driver mechanism and a larger number of parts. Particularly in a flat clinch type electric stapler in which the legs of staples are bent by means of pivotal clinchers, a slight positional error may cause defective clinching to occur, thus narrowing an allowable error range.

As a typical conventional electric stapler is not equipped with a clincher-to-driver position adjusting means, the problem is that extreme precision is required during machining and assembling in order to limit an error to a predetermined value or smaller.

With respect to a staple cartridge, in a conventionally known staple detecting unit, a sensor for detecting the presence or absence of staples in the staple cartridge is provided so that no-load running is prevented by breaking a staple driving circuit when the remainder of staples is running low.

Such a sensor in the staple detecting unit is mounted in the cartridge holder of the electric stapler and in the case of a type in which a sensor like a photointerrupter or an microswitch is switched on and off by an actuator, the actuator is projected into the staple passage of the staple cartridge and brought into contact with a staple.

When the end of the staple passes by the actuator, the actuator turns to reverse the output of the sensor and the driving circuit is cut off to establish a start suspending condition.

The rotational quantity of the actuator at the time the staple passage is detected is equal to the thickness of a staple wire and because the sensor is turned on and off by a very small rotational quantity, extreme accuracy is required for machining and assembling the staple cartridge, the cartridge holder and the actuator.

Although some of the staple detecting units are provided with a non-contact sensor such as a photosensor in a cartridge holder, they tend to lack stability in detecting a staple as the threshold value of the sensor is caused to fluctuate by the slight displacement of the relative position between the staple in the staple cartridge and the sensor.

Among electric staplers whose staple feeding mechanisms are designed to feed staples by means of a longitudinally reciprocating feed pawl or an endless belt, a feed-pawl type staple feeding mechanism is provided with a check pawl for preventing staples from moving back in its staple cartridge.

Such a check pawl is usually installed on the downstream or upstream side of the feed pawl. In any one of these types, however, no staples can be fed by the feed pawl any longer at a point of time the last linked staple is fed forward by the feed pawl after the staples in the cartridge are totally consumed. Consequently, a few staples out of those ranging from the head to the last one within the staple cartridge become unusable.

It has heretofore been common practice to replace the staple cartridge and to discard the used one when the feeding of staples becomes impossible. If, therefore, the staple cartridge is made repeatedly usable by having it replenished with staples, it will be considered contributable to saving resources and protecting the natural environment.

When a staple cartridge of such a type that a check pawl is disposed on the downstream side of a feed pawl and is replenished with new linked staples, however, the head portion of a newly supplied staple sheet is brought into contact with the rear end portion of the remaining staple sheet in the cartridge and the newly supplied staple sheet will not engage with the check pawl on the downstream side of the feed pawl. Consequently, the newly supplied staple sheet together with the feed pawl will repeatedly move back and forth and no staples can be supplied to the driver portion.

In the case of a staple cartridge with the check pawl arranged on the upstream side of the feed pawl, further, newly supplied staples can be made to engage with the check pawl on the condition that staples are supplied to the cartridge that has consumed its staples until the feeding of them becomes impossible. After the end of the staple sheet passes by the check pawl, there develops another problem arising from causing the staples connected together with an adhesive to be severed by the longitudinal reciprocating motion of the feed pawl, to be fed unstably or non-conformably, or otherwise having the staple cartridge clogged therewith Referring to FIGS. 23A to 25B, several kinds of conventional staple supporting units are shown. In FIG. 23A, reference numeral 341 denotes a staple pusher; 342, a driver; 343, a forming plate in the form of a gantry; 344, a staple guide; and a reference symbol S, a linked staple sheet.

The staple pusher 341 placed under the staple guide 344 is longitudinally slidably mounted on a base (not shown), urged by a spring (not shown) in the direction of a front-end plate and as shown in FIG. 23A, forced to contact the front-end plate 345. A projected portion 341a slightly narrower than the central recessed portion of the forming plate 343 is formed in the front center of the staple pusher 341, and the upper front edge portion of the staple pusher 341 is chamfered over the whole width. Moreover, a projected portion 344*a* in agreement with the forming dimensions of a staple is projected forward in the front central portion of the staple guide 344, and both sides of the linear staple are bent into a gantry shape by the forming plate 343 along the respective sidewalls of the projected portion 344*a* of the staple guide 344.

A recess 345*a* substantially equal in width to the staple subjected to forming is formed in the center of inner sidewall of the front-end plate 345, and the formed staple is pressed by the staple pusher 341 into the recess 345*a* and held by the front-end plate 345 and the staple pusher 341.

FIGS. 23A and 23B show the standby state wherein a first staple S1 and one S2 on a second row have already been formed into a gantry shape, and the first one S1 stays in the recess 345*a* of the front-end plate 345.

As shown in FIGS. 24A and 24B, the driver 342 and the forming plate 343 are integrally moved down and simultaneously when the first staple S1 is struck by the driver 342 and starts penetrating into an object, both lateral sides of a liner staple S3 on a third row are pressed down by the forming plate 343 and bent along both the lateral sidewalls of a protrusion 345*a* of the staple guide 344. Further, the driver 342 and the forming plate 343 press the chamfered upper edge portion of the staple pusher 341 so as to move back the staple pusher 341. As shown in FIGS. 24A and 24B, further, the driver 342 and the forming plate 343 are moved down up to the lowest point, whereby the driving and forming of the staple are simultaneously completed.

When the driver 342 and the forming plate 343 are moved up subsequently, the whole linked staple sheet S is moved forward by a feed mechanism, and the first gantry-shaped staple is inserted in the recess 345*a* of the front-end plate 345. Then the staple pusher 341 is moved forward, so that the gantry-shaped staple is clamped between the front-end plate 345 and the staple pusher 341.

During the aforementioned drive-in stroke, it is desirous that the driver and the forming plate are brought into contact with the staple at the same time and when the forming plate comes into contact with the staple pusher earlier than the driver, the staple pusher is moved back before the staple is driven into the object and the staple may tilt and buckle in posture.

When the driver otherwise comes into contact with the staple pusher earlier than the forming plate, the staple pusher is moved back before the forming, which causes non-conforming forming. Although it is therefore attempted to design a staple pusher so that a driver and a forming plate are simultaneously brought into contact with a staple pusher, forming accuracy is hardly controllable and the problem is that above-described instability due to variation with time tends to occur.

SUMMARY OF THE INVENTION

It is therefore a first object of the present invention to technically solve the problem of facilitating assembling and maintenance work by making adjustable the vertical position of a driver.

It is therefore a second object of the present invention to technically solve the problem of not only improving the assembling accuracy but also stabilizing the performance of an electric stapler.

It is therefore a third object of the present invention to technically solve the problem of improving operational stability in detecting a staple.

It is therefore a fourth object of the present invention to technically solve the problem of providing a staple cartridge capable of repeated use by ensuring that a staple sheet newly supplied subsequently to what is remaining in the staple cartridge is continuously fed.

It is therefore a fifth object of the present invention to technically solve the problem of improving stability the driving and forming of staples.

In order to accomplish the objects, a driver unit for an electric stapler comprising: a frame; a driver support member vertically movably mounted on the frame; a driver having a plate-like shape, fitted to the driver member such that the driver is vertically slidable in a predetermined range with respect to the driver support member; a driver hoist mechanism for driving the driver support member, driven by a motor to lower from an upward standby position to eject a staple to clinchers arranged right below the driver; and vertical position adjusting means provided between the driver support member and the driver, for adjusting a vertical position of the driver with respect to the driver support member.

Further, the present invention provides an electric stapler comprising: a frame having a driver hoist lever; a staple cartridge holder provided with the frame, for receiving a staple cartridge, wherein the staple cartridge holder is longitudinally slidable with respect to the frame; a driver placed in a front portion of the staple cartridge holder; a driver hoist mechanism coupled to the driver, wherein a staple is ejected below by striking the staple in the staple cartridge loaded in the staple cartridge holder with the driver; fixing means for securing the staple cartridge holder to any desired longitudinal position; a driver guide groove formed in the front portion of the staple cartridge holder; and a guide pin coupled to the driver fitted in the driver guide groove, wherein the guide pin is mount in a leading end region of the driver hoist lever pivotally connected to the frame.

Still further, the present invention provides a staple detecting unit in an electric stapler for detecting staples in a staple cartridge mounted on a cartridge holder, comprising: an actuator sensor provided in the cartridge holder of the electric stapler and connected to a drive control circuit; and an actuator provided in the staple cartridge, wherein the actuator is coordinated with the actulator sensor such that the staple cartridge has been loaded in the cartridge holder, and the actuator is brought into contact with linked staples in the staple cartridge, to make the sensor detect the presence or absence of the staples.

Still further, the present invention provides a staple detecting unit in an electric stapler for detecting staples in a staple cartridge mounted on a cartridge holder, comprising: a staple detecting sensor provided in the staple cartridge; an external contact provided on an outer sidewall of the staple cartridge; a circuit contact kept in contact with an external contact provided in the cartridge holder of the electric stapler; and a drive control circuit connected to the circuit contact to make the sensor detect the presence or absence of the staples in the staple cartridge loaded in the cartridge holder.

Still further, the present invention provides a staple cartridge for an electric stapler, which staple cartridge is used for supplying linked staples to a driver passage by driving a feed pawl to longitudinally reciprocate, the staple cartridge comprising: a staple containing chamber to be replenished with linked staples; and a check pawl for engaging with the linked staples in the staple cartridge in order to block the linked staples from moving back arranged both in front and in the rear of a range in which the feed pawl is longitudinally moved.

In order to accomplish the object proposed according to the present invention, a staple support unit for an electric stapler comprising a staple guide for guiding linked staples in the form of linear staples bonded in parallel, a driver moved up and down along a front-end plate placed on the downstream side of the staple guide, a forming plate whose movement on the back side of the driver is interlocked with the hoist operation of the driver, and a staple pusher moved back from the passages of the driver and the forming plate when struck by the driver and the forming plate, is such that longitudinally slidable staple support plates are provided beneath the staple pusher; the staple support plates are urged by springs forward so that the staple support plates are brought into contact with the lower inner sides of the respective lateral legs of the staple; and the upper front-end portions of the staple support plates are chamfered so that the staple support plates are moved back from the passage of the driver when struck by the driver.

BRIEF DESCRIPTION OF THE DRAWINGS

FIG. 26A is in a standby state and 26B is in a clinching state;

DETAILED DESCRIPTION OF THE PREFERRED EMBODIMENTS

Figure 1:
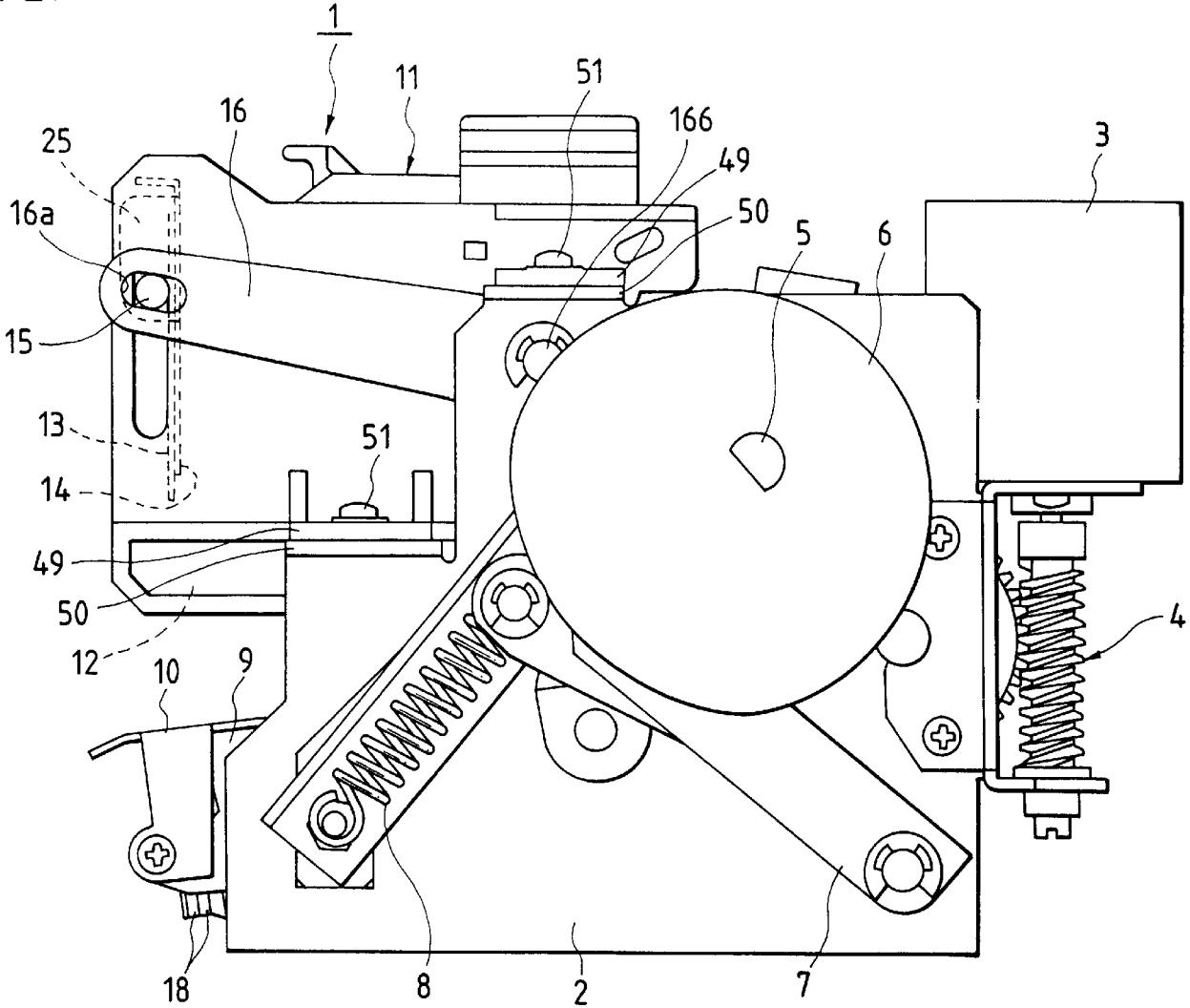
FIG. 1 is a side view of an electric stapler according to the present invention.
Figure 2:
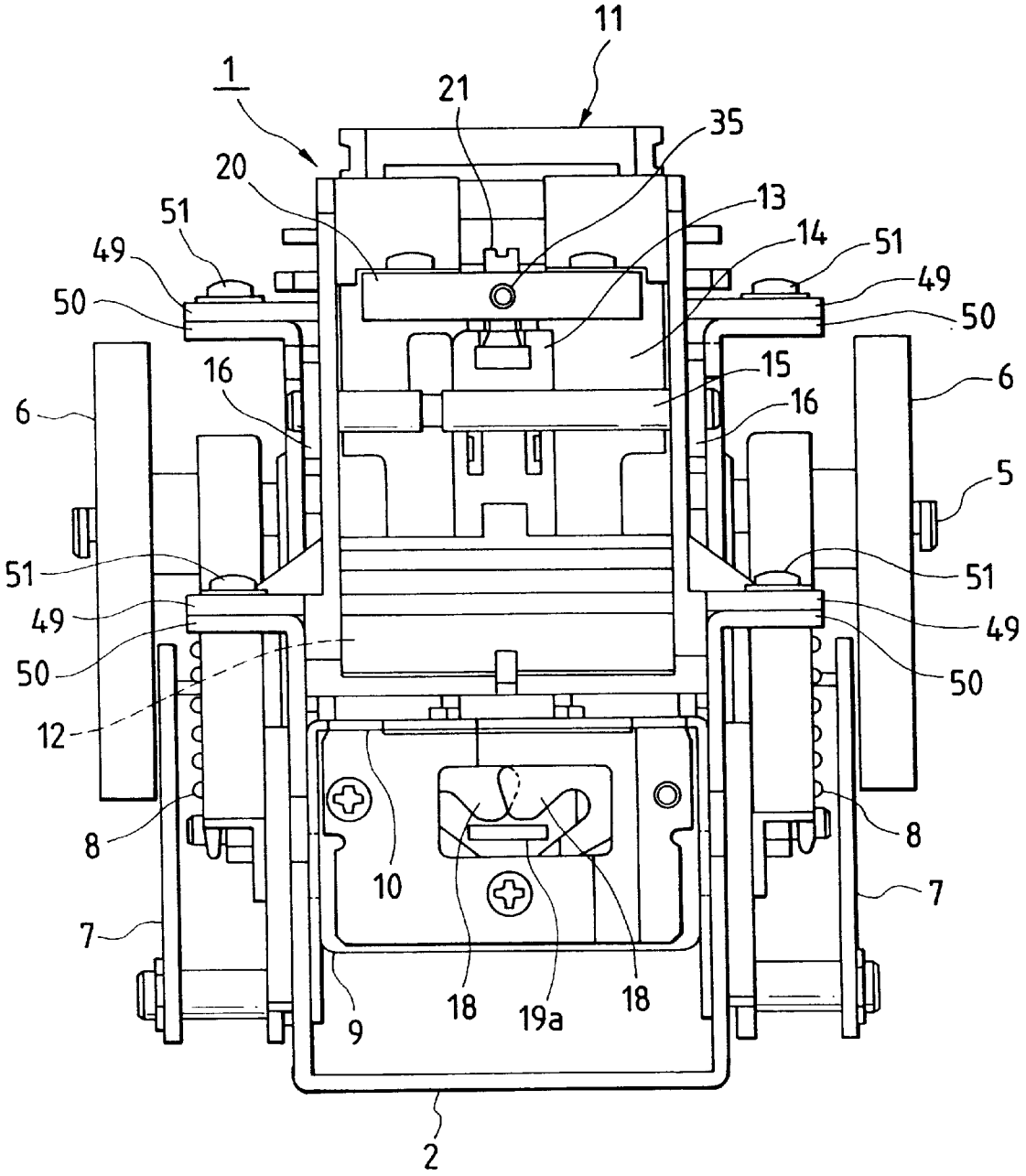
FIG. 2 is an elevational view of the electric stapler shown in FIG. 1.
Figure 3:
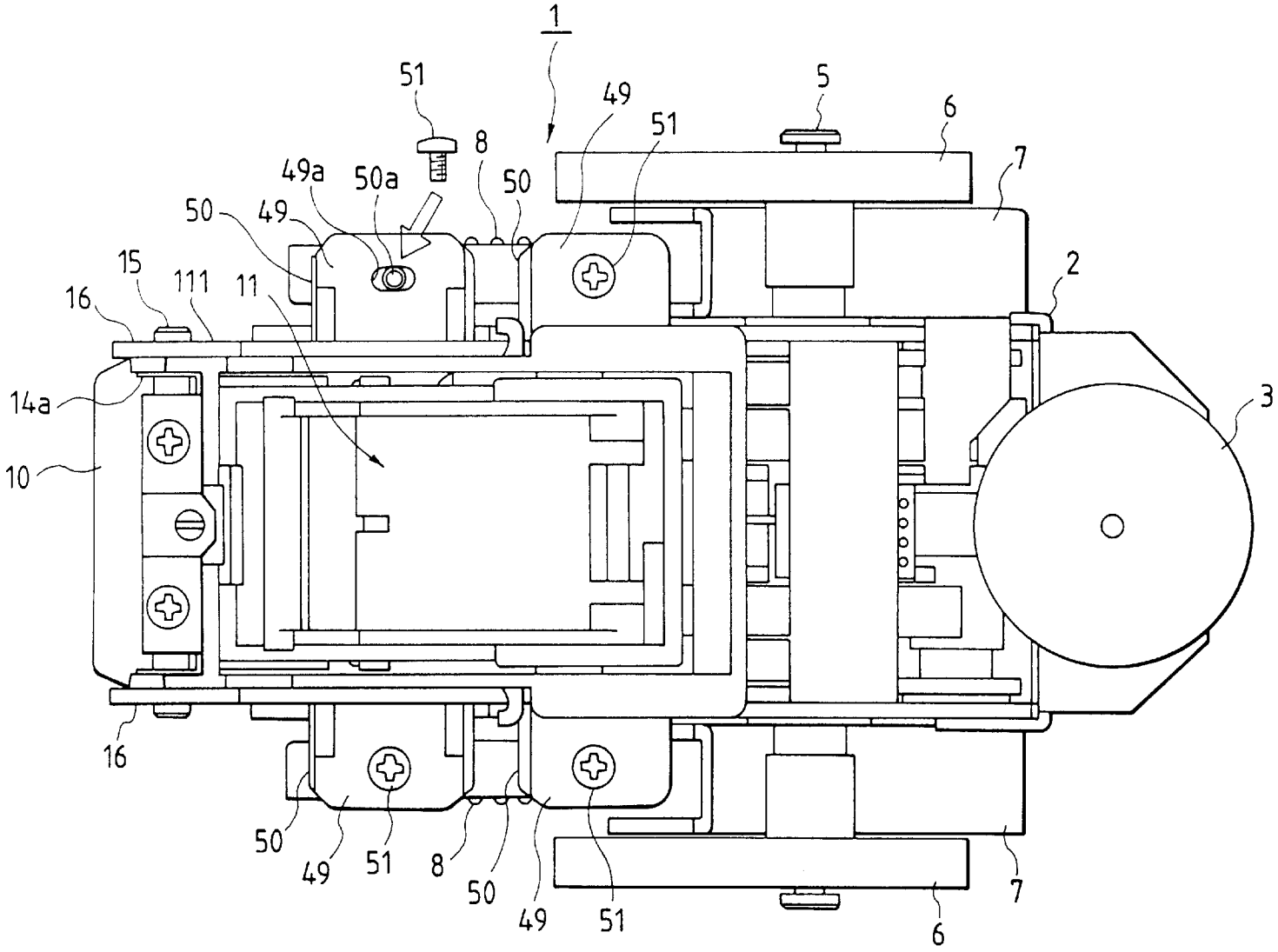
FIG. 3 is a plan view of the electric stapler shown in FIG. 1.

Referring to the accompanying drawings, there will be given a detailed description of an embodiment of the present invention. FIGS. 1–3 show an electric stapler 1, the motive power of a motor 3 fitted to the rear portion of a frame 2 shown in FIG. 1 (right-hand side therein) being transmitted to a drive shaft 5 via a reduction gear mechanism 4, whereby table driving cams 6 mounted on a drive shaft 5, driver and clincher driving cams (described later) are driven.

The table driving cam 6 longitudinally and reciprocally swings a table hoist lever 7, thus causing table support arms 9 coupled via extension springs 8 to the table hoist lever 7 to move up and down. A table 10 pivotally connected to the front-ends of the table support arms 9 faces a staple guide 12 under a staple cartridge 11.

In the staple cartridge 11 loaded in the front portion of frame 2, a roll-like staple sheet for linking together a number of bonded linear staples is contained. The staple sheet is paid out forward on the staple guide 12 within the staple cartridge 11 by a staple feeding pawl (not shown) whose movement is interlocked with the hoist operation of a driver 13 before the staple is bent into a gantry shape by a forming plate 14 which is moved up and down together with the driver 13.

The pin 15 mounted on the forming plate 14 is passed through a slot 16*a* in the front portion of a driver hoist lever 16, and the driver 13 mounted in the front portion of the forming plate 14 and the forming plate 14 are coupled to the driver hoist lever 16.

Figure 4:
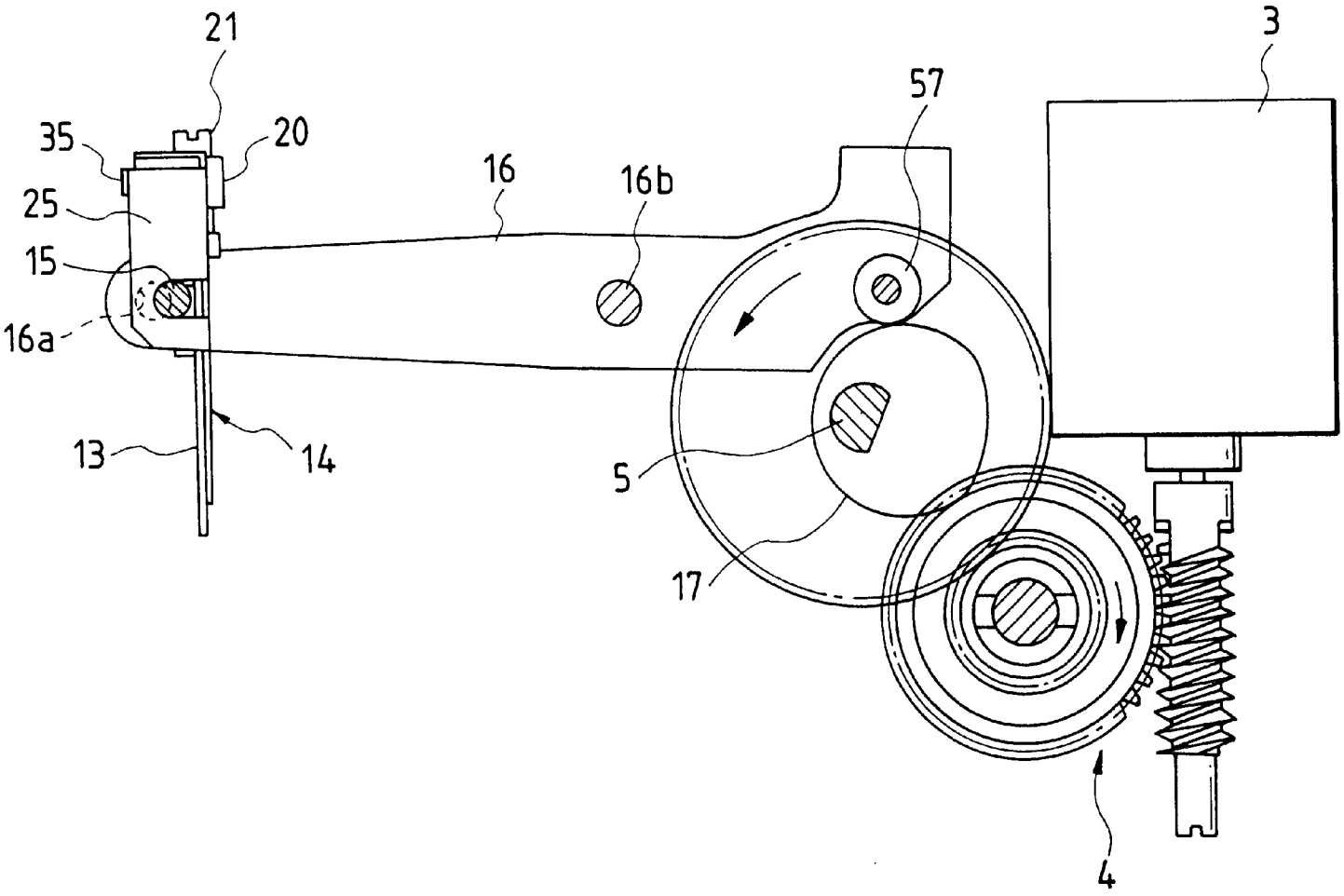
FIG. 4 is a side view of a driver unit of the electric stapler.

As shown in FIG. 4, a driver unit comprises a driver driving cam 17, the driver hoist lever 16, the driver 13 and the forming plate 14. The rear end portion of the driver hoist lever 16 mates with the driver driving cam 17 and when the driver driving cam 17 rotates once from the initial position, the driver 13 and the forming plate 14 are moved down from the upper standby position and then returned to the upper standby position again.

As shown in FIG. 2, the inner end portions of a pair of lateral clinchers 18 mounted in the front portions of the respective table support arms 9 longitudinally intersect each other. The leading end portion 19*a* of a clincher arm is positioned right below the intersecting portion. The clincher arm 19 is driven by the clincher driving cam to move up and down.

When a paper detection switch (not shown) is turned on after paper is inserted in between the table 10 and the staple guide 12, the motor 3 starts to rotate the drive shaft 5, and the table hoist lever 7 tilted forward as shown in FIG. 1 is moved upward and draws up the table support arm 9. Then the paper is clamped between the table 10 and the staple guide 12, and the driver 13 and the forming plate 14 are moved down by the driver driving cam 17. Further, a staple in the front row is driven by the driver 13 into the paper on the table 10 and another one in the back row is formed by the forming plate 14 into a gantry shape.

The driver 13 is moved down to the lowest point and when the legs of the ejected staple are moved down through the slot provided in the table 10, the leading end portion 19*a* of the clincher arm starts to move up. While the lateral clinchers 18 are pressed by the leading end portion 19*a* of the clincher arm during the symmetrical moving-up and turning stroke, the lateral legs of the staple are pressed inward and bent by the inner edge faces of the clinchers 18.

Subsequently, the table support arm 9 and the leading end portion 19*a* of the clincher arm are moved down, whereas the driver 13 and the forming plate 14 are moved up and returned to the respective standby positions. Then the operation of the motor 3 is then stopped and one cycle stroke is terminated.

Figure 5B:
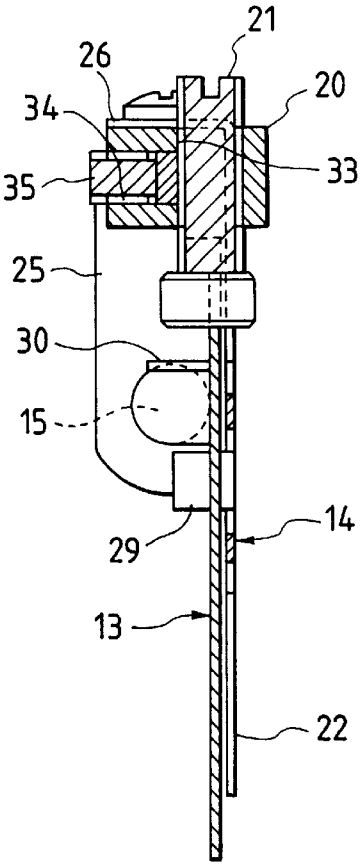
FIGS. 5A and 5B show elevational and sectional views of the driver portion of a driver unit according to the present invention.
Figure 5A:
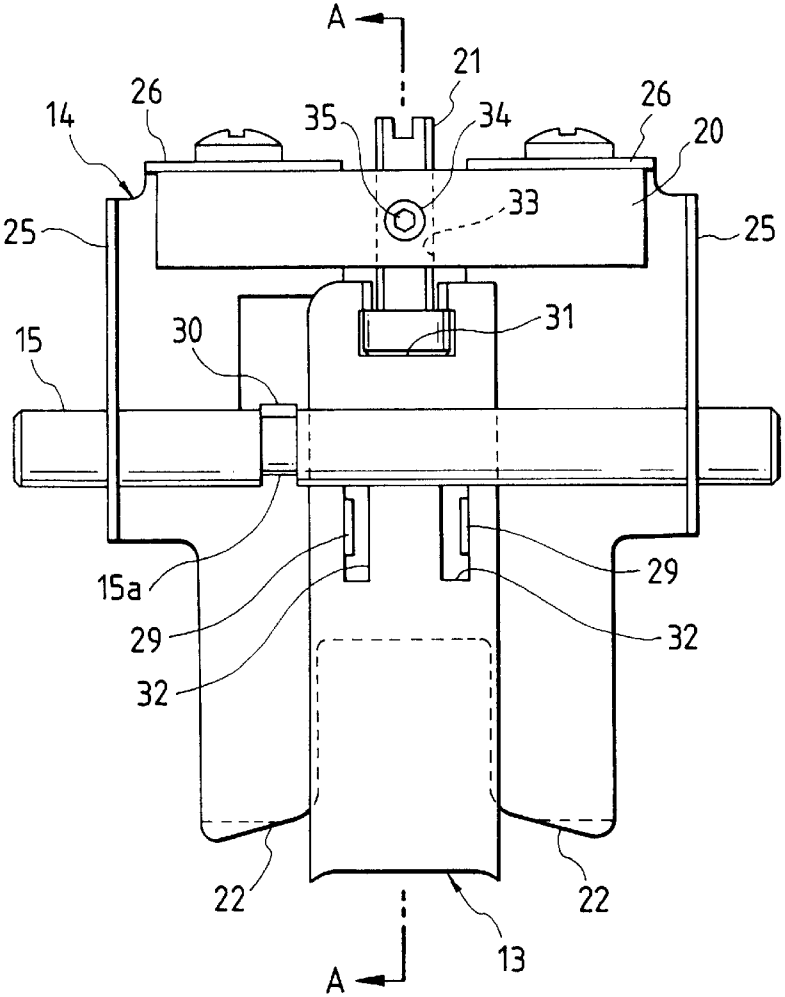

A description will subsequently be given of the driver unit. FIGS. 5A and 5B show a driver unit according to the present invention wherein an adjusting-screw base block 20 is mounted on the forming plate 14 as a driver support member and the driver 13 is fitted via the T-bolt 21 screwed into the adjusting-screw base block 20.

Figure 6A:
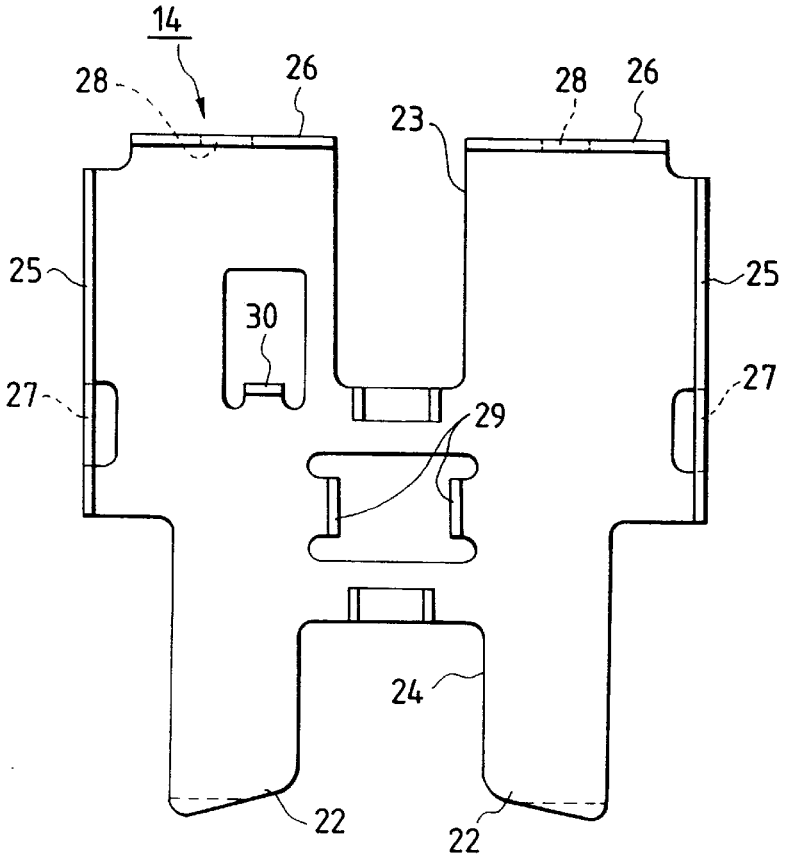
FIGS. 6A, 6B and 6C are elevational, side and bottom views of a forming plate according to the present invention.
Figure 6B:
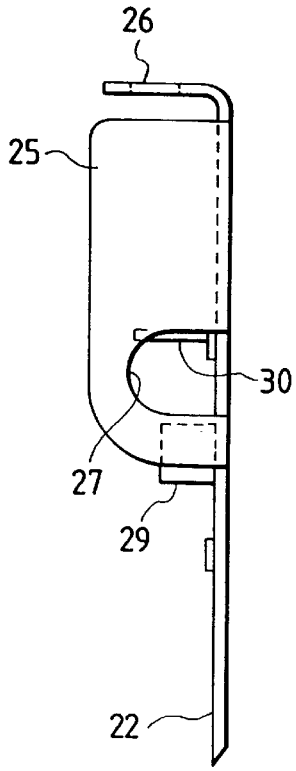
Figure 6C:
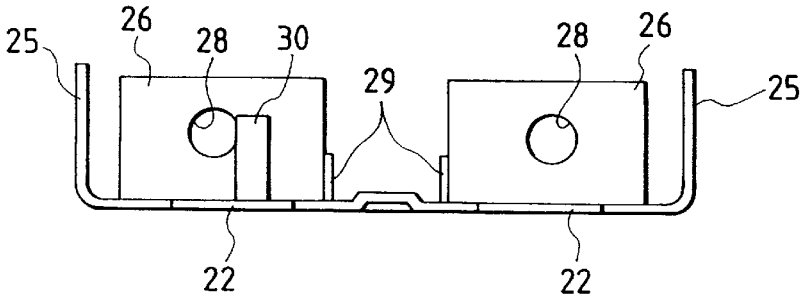

FIGS. 6A–6C show the forming plate 14 provided with a forming portion 22 projecting downward from both left and right sides, and grooves 23, 24 each extending toward vertical intermediate regions from the center at both upper and lower ends. Side plate portions 25, 26 bent at right angles are each formed at both lateral ends and the upper end of the forming plate 14. A hole 27 for laterally receiving the pin 15 is provided in both lateral side plate portions 25, and holes 28 for fixing the adjusting-screw base block 20 with screws are each provided in the upper-end side plate portions 26. Moreover, a pair of lateral pawls 29 for positioning the driver 13 are cut upward in the center portion, and a pin-stopper pawl 30 is also cut upward on the left-hand side of the upper groove 23.

Figure 7A:
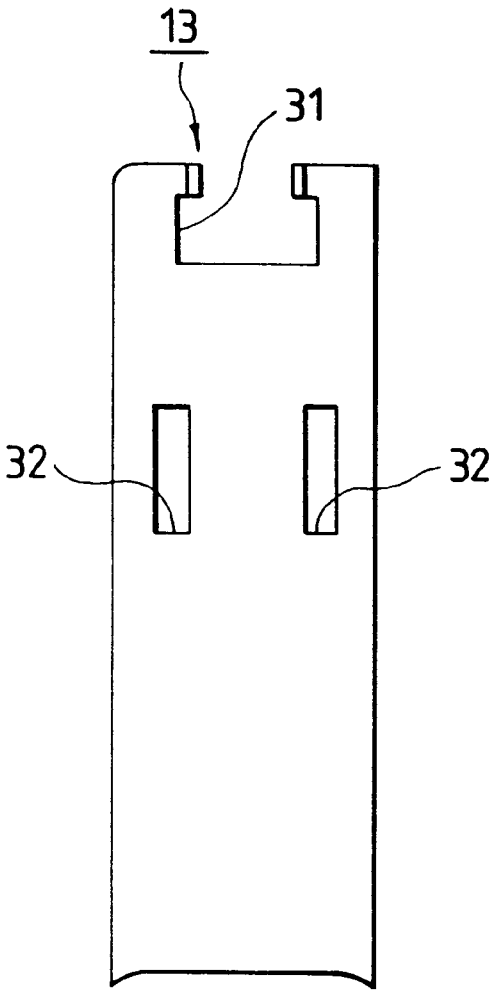
FIGS. 7A, 7B and 7C are elevational, side and bottom views of a driver according to the present invention.
Figure 7B:
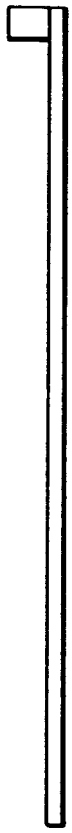
Figure 7C:
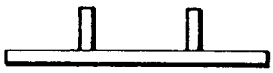

FIGS. 7A–7C show the driver 13 formed with a T-groove 31 mating with the T-bolt in the upper end center, and a pair of vertical slots 32 punched in the vertical intermediate portion and used for receiving the respective pawls 29 of the forming plate 14.

As shown in FIGS. 5A–5B, the adjusting-screw base block 20 is secured to the upper side plates 26 of the forming plate 14 with screws, and the T-bolt 21 is screwed from below into a vertical tapped hole 33 bored in the center of the adjusting-screw base block 20. A slot is provided in the screw-side front end (upper end in FIG. 5A–5B) of the T-bolt 21, so that the T-bolt can be rotated in any desired direction with a screw driver. The flat head of the T-bolt 21 is mated with the T-groove 31 of the driver 13 and so are the slots 32 of the driver 13 with the pawls 29 of the forming plate 14. When the T-bolt 21 rotates, the driver 13 is moved up or down in accordance with the rotational direction thereof with respect to the forming plate 14. A tapped hole 34 for a locking screw 35 is provided in the center of the front of the adjusting-screw base block 20 and the locking screw 35, allows the T-bolt 21 to be fixed in an unrotatable state.

When the pin 15 is passed through the slot 16*a* of the driver hoist lever 16 and the slot 27 of the forming plate 14 at the time of assembling the driver unit 13, the driver unit 13 is held with the pin 15 crossing the front of the driver unit 13 and the forming plate 14 on the back side. The driver unit 13 and the forming plate 14 are coupled to the driver hoist lever 16.

Further, the pin 15 corresponding to the position of the pin-stopper pawl 30 of the forming plate 14 has been cut smaller in diameter and by mating the pin-stopper pawl 30 with this small-diameter portion 15*a*, the pin 15 is secured to the forming plate 14.

To adjust the lowest position of the driver 13 at the time the stapler is driven, the locking screw 35 is loosened to turn the T-bolt 21 first and then tightened after the vertical position of the driver 13 is adjusted, whereby the driver unit is fixed in a proper position with respect to the driver hoist lever 16 and the forming plate 14.

Figure 8B:
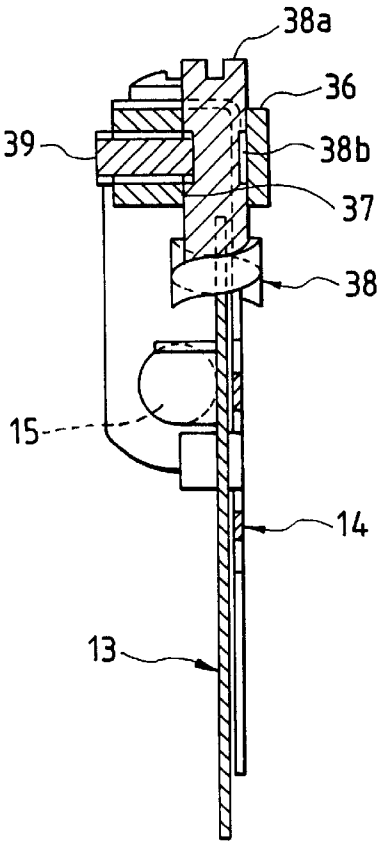
FIGS. 8A and 8B are elevational and sectional views showing the driver portion of a driver unit according to the present invention.
Figure 8A:
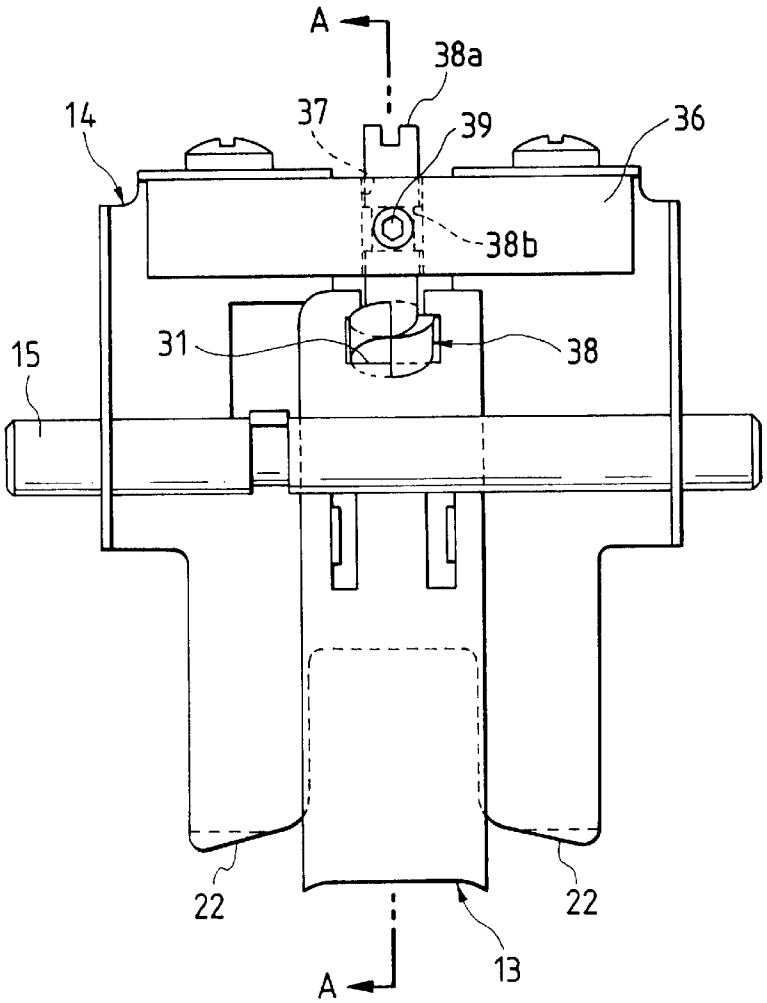

FIGS. 8A–8B show a driver according to the present invention wherein a vertical hole 37 is provided in the center of an adjusting-screw base block 36 mounted on the forming plate 14, and the rotational center shaft 38*a* of a tilted disc cam 38 is inserted in the hole 37 from below. A peripheral groove 38*b* is formed in the vertical intermediate portion of the rotational center shaft 38*a*, and the leading end portion of a locking screw 39 mounted on the front of the adjusting-screw base block 36 is inserted in the groove 38*b* and tightened so as to fix the tilted disc cam 38. The tilted disc cam 38 is in 180° (degree) rotational symmetry and the tilted disc cam 38 is mated with the T-groove 31 of the driver 13 to support the driver 13.

When the vertical position of the driver 13 is adjusted like that in the driver unit of FIGS. 5A–5B, the locking screw 39 is loosened to turn the tilted disc cam 38, whereby the driver 13 is moved up or down in accordance with the rotational direction of the tilted disc cam 38. When the locking screw 39 is tightened after the vertical position is adjusted, the tilted disc cam 38 is fixed in an unrotatable state, so that the vertical position of the driver 13 with respect to the driver hoist lever 16 and the forming plate 14 is set invariable.

The adjusting of the driver postion with respect to the clincher will be described below.

A shaft 16*b* in the intermediate portion of the driver hoist lever 16 is pivotally supported by the frame 2, and a roller 57 provided in the rear end portion of the driver hoist lever 16 is mated with a driver driving cam 17 fitted to the drive shaft 5 as shown in FIG. 4. When the driver driving cam 17 is driven to turn once from the initial position, the driver 13 and the forming plate 14 are moved down from an upper standby position and returned to the upper standby position again so as to perform one cycle hoist operation.

As shown in FIGS. 1–3, brackets 49 projecting outward to the front and rear parts are formed in the lateral sidewall portion of the staple cartridge holder 111, and screw bearing brackets 50 for mounting the brackets 49 of the staple cartridge holder 111 are also provided for on the frame 2.

As shown in FIG. 3, longitudinal slots 49*a* are provided for in the brackets 49 of the staple cartridge holder 111, and tapped holes 50*a* are bored in the screw bearing brackets 50 of the frame 2. Further, four locking screws 51 are inserted through the slots 49*a* of the staple cartridge holder 111 and fastened to the tapped holes 50*a* of the frame 2 so as to secure the staple cartridge holder 111 to the frame 2.

When the longitudinal position of the driver 13 with respect to the clinchers 18 is adjusted, the staple cartridge holder 111 is slid in such a state that the locking screws 51 have been loosened in order to move the guide pin 15 used to support the driver 13 along the slot 16*a* of the driver hoist lever 16 together with the staple cartridge holder 111. Then the locking screws 51 are tightened after the longitudinal position of the driver is adjusted and the staple cartridge holder 111 is fixed. Needless to say, no trouble is brought about the ejection of a staple because of the positional adjustment of the driver 13 since the relation position among the driver 13, the staple cartridge 11 and the staple in the staple cartridge holder 111 is not varied.

Figure 14A:
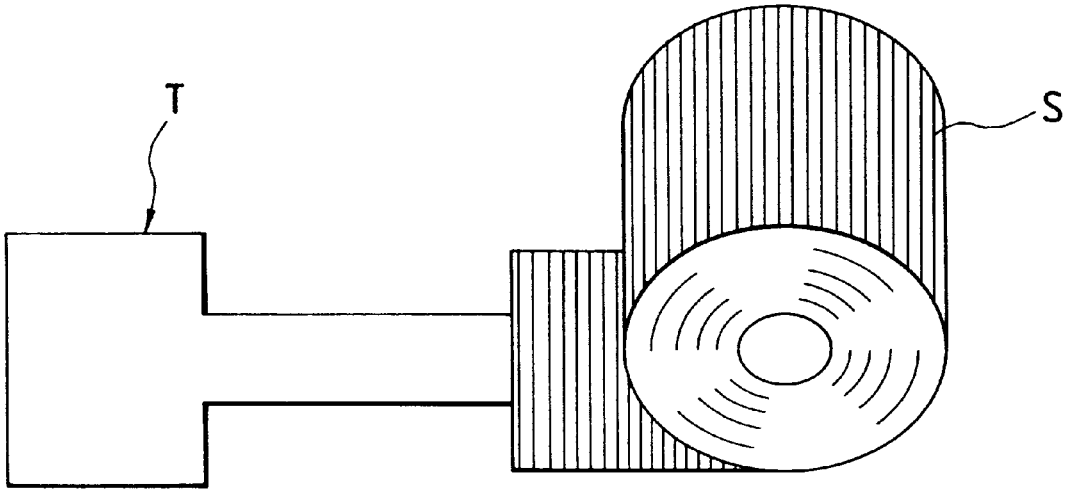
FIGS. 14A and 14B show a staple sheet for using in the staple cartridge.
Figure 14B:
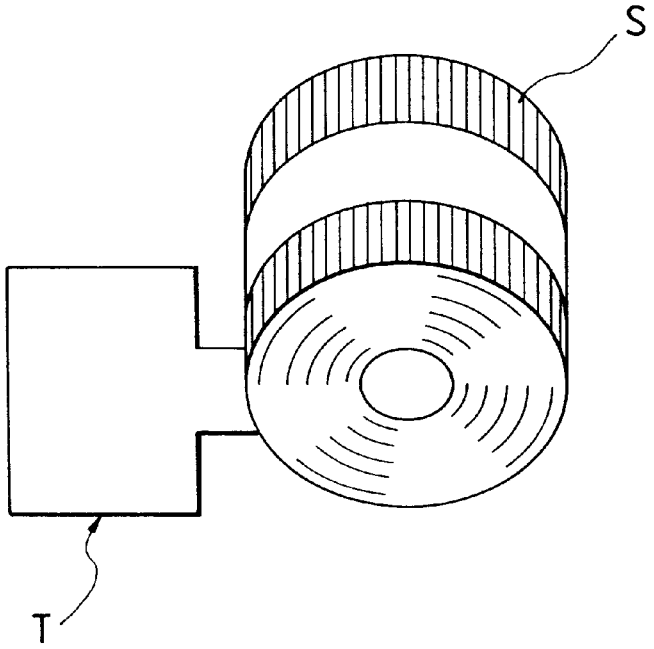

FIGS. 14A and 14B show a roll-like staple sheet S for using in the cartridge holder 111. A tape T is adhered to the backside of the roll-like staple sheet S, so that the foremost staple in the staple sheet is sufficiently drawn at a predetermined position of the cartridge holder 111.

Figure 9:
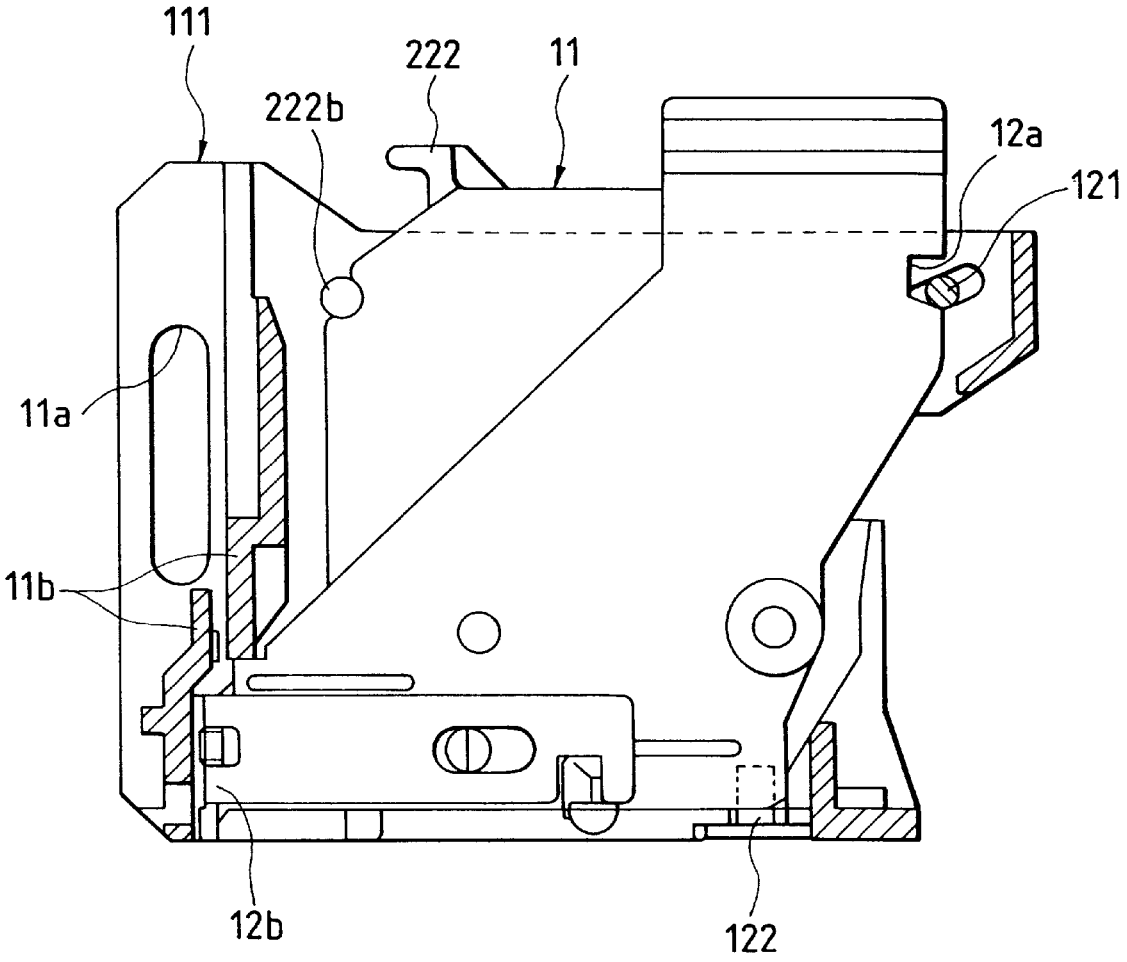
FIG. 9 is a partial sectional side view of a cartridge holder and a staple cartridge in a staple detecting unit according to the present invention.

FIG. 9 shows the cartridge holder 111 and the staple cartridge 11. In the staple cartridge 11, a roll-like staple sheet with a number of linear staples bonded in parallel and coupled together is contained. When the staple cartridge 11 is inserted from above in the cartridge holder 111, a lock pin 121 extending in the rear portion (right-hand side therein) of the lateral side plate of the cartridge holder 111 is mated by the force of a spring (not shown) with a groove 12*a* in the upper back portion of the staple cartridge 11, and the staple cartridge 11 is pressed forward and downward so that it is fixed.

A photointerrupter 122 mounted in the rear portion of the bottom plate of the cartridge holder 111 is inserted in the staple cartridge 11 via a hole in the bottom of the staple cartridge 11 when the photointerrupter 122 is loaded in the staple cartridge. The driver 13 and the forming plate 14 are moved down in the driver guide 11*b* provided in the front portion of the cartridge holder 111 and passed through a driver passage 12*b* in the front-end portion of the staple cartridge 11.

Figure 10:
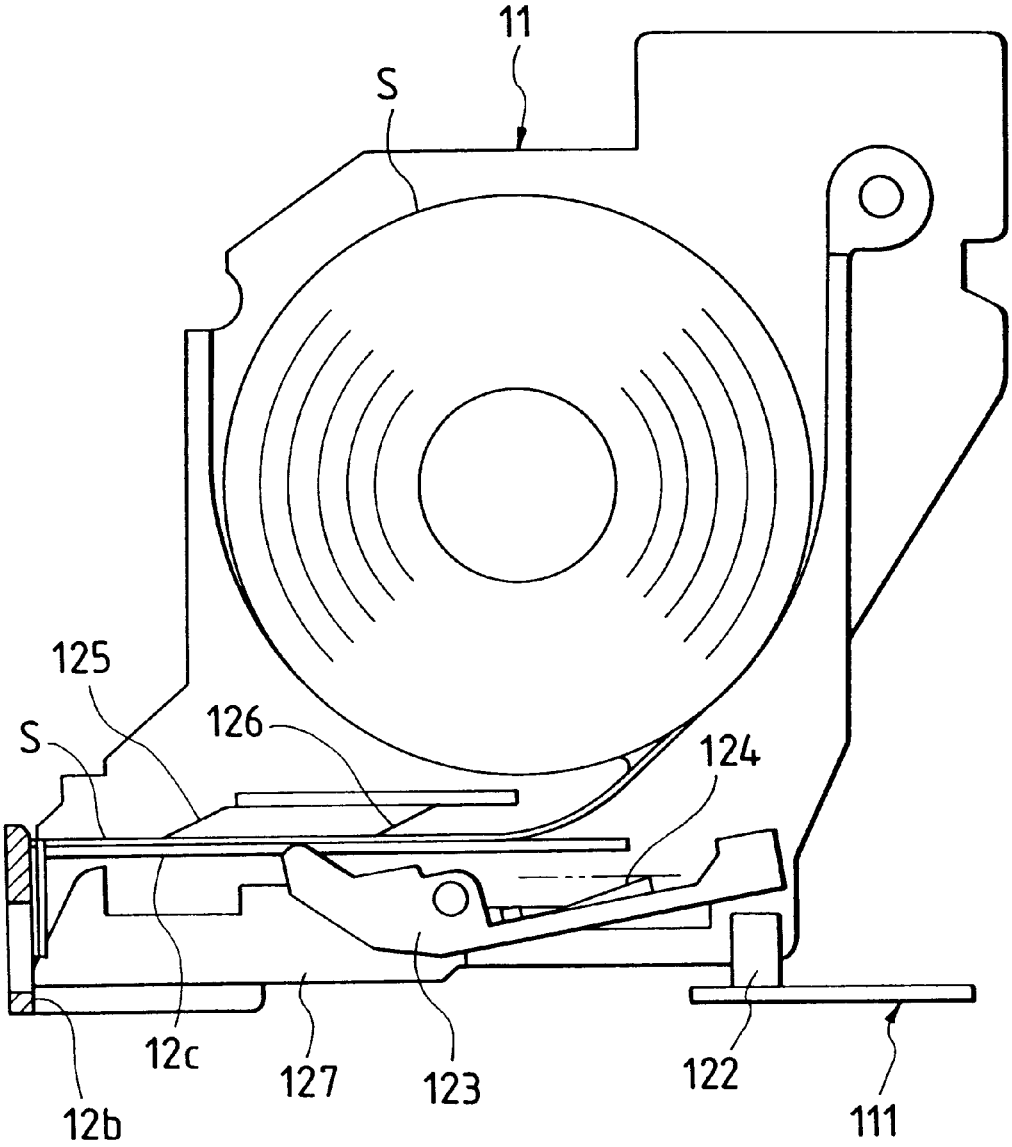
FIG. 10 shows the staple detecting according to the present invention and is explanatory of a state in which staples still remain.

As shown in FIG. 10, an actuator 123 for operating the photointerrupter 122 is vertically pivotally mounted in a lower portion within the staple cartridge 11. The actuator 123 is urged by a plate spring 124 clockwise in FIG. 10 and its front-end portion is projected above a staple guide 12*c* via a hole made in the staple guide 12*c*.

The photointerrupter 122 is connected to the drive control circuit (not shown) of the electric stapler and when the output of the photointerrupter 122 is in an ON state, the driving motor is on standby and ready for starting, whereas in an OFF state, the drive circuit is cut off, whereby the starting of the motor is prohibited.

When the staple sheet S is situated on the staple guide 12*c*, the front portion of the actuator 123 is pressed down by the staple sheet S and its rear portion is turned up, so that the rear end portion is released from the light path between the light emitting and receiving elements of the photointerrupter 122. The output of photointerrupter 122 is ON in this state and the motor 3 is on standby and ready for starting.

Figure 11:
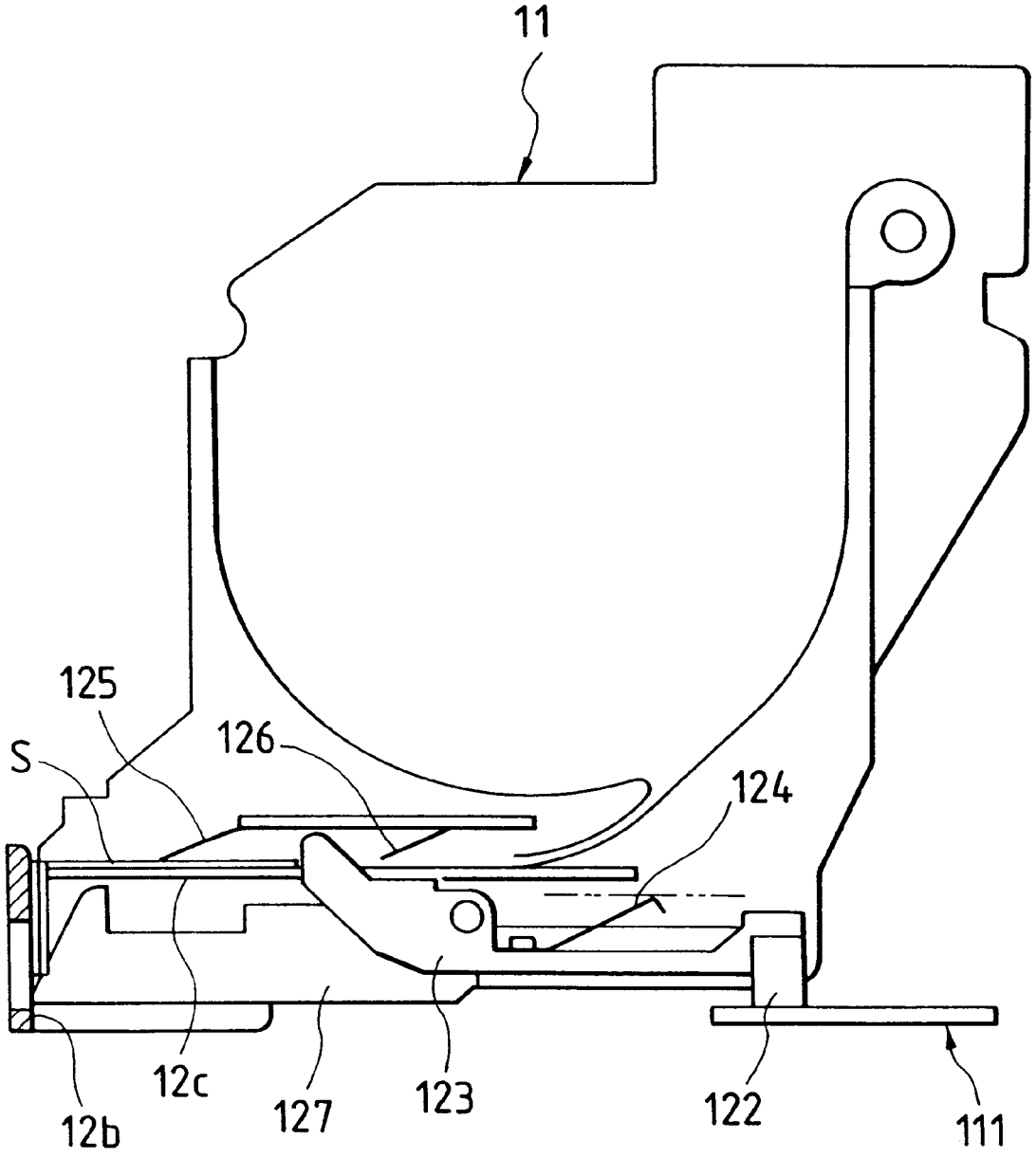
FIG. 11 shows the staple detecting unit according to the present invention explanatory of a state in which the staples have been consumed.

As shown in FIG. 11, the actuator 123 whose rotation has been controlled by the staple sheet S is turned clockwise when the end of the staple sheet S passes the position of the front-end portion of the actuator 123 as the remainder of the staple sheet S in the staple cartridge 11 is running out, and the rear end portion of the actuator 123 enters between the light emitting and receiving elements of the photointerrupter 122; consequently, the output of the photointerrupter 122 is changed from ON to OFF. Thus, the starting of the motor 3 of the electric stapler is prohibited. An off signal may otherwise be used to display a staple supplement message on a display unit.

In this case, a first check pawl 125 and a second check pawl 126 behind the first one are formed above the staple guide 12*c* and kept in contact with the surface of the staple sheet S. Reference numeral 127 denotes a staple feeding plate which longitudinally slides under the staple guide 12*c*, its front edge face being tilted from the upper side to the lower side.

Figure 12A:
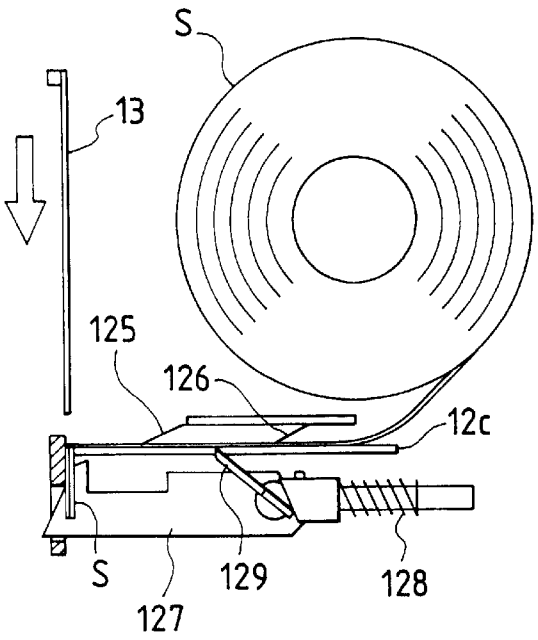
FIGS. 12A, 12B and 12C are explanatory views of the operations of a staple feeding mechanism.
Figure 12B:
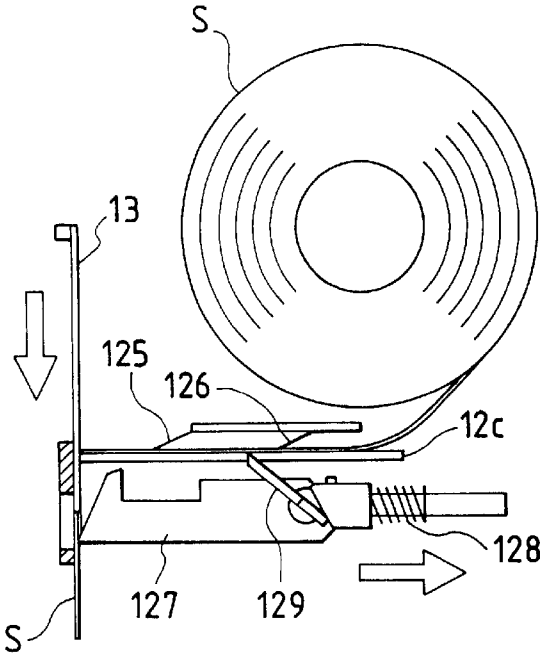
Figure 12C:
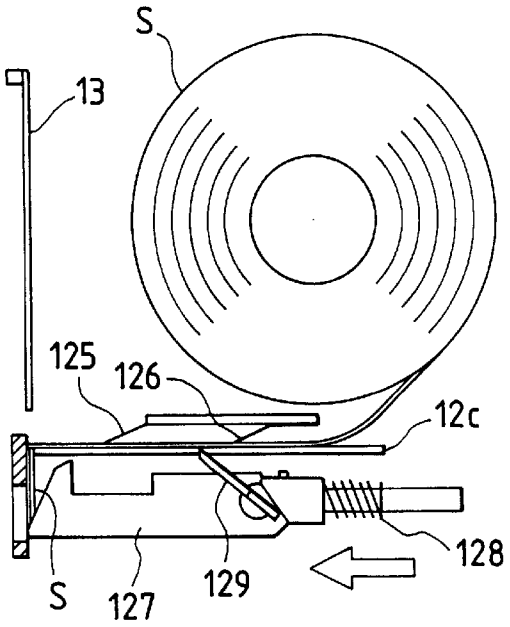

A description will subsequently be given of a staple feeding mechanism. FIGS. 12A to 12C show a staple feeding mechanism in which the staple feeding plate 127 is urged forward by a compression spring 128. In the standby state shown in FIG. 12A, the front-end portion of the staple feeding plate 127 is projected forward from the passage route of the driver 13. Further, the front end of a feed pawl 129 pivotally connected to the staple feeding plate 127 is positioned between the first and second check pawls 125, 126.

When the driver 13 is moved down after the electric stapler is started as shown in FIG. 12B, the driver 13 and the staple struck thereby are brought into contact with the front-end tilted surface of the staple feeding plate 127 and move back the staple feeding plate 127. The feed pawl 129 then moves back while sliding on the back of the staple sheet S held by the first and second check pawls 125, 126 in such a way that it is blocked from moving back. As shown in FIG. 12C, subsequently, the feed pawl 129 together with the staple feeding plate 127 are moved forward when the driver 13 moves up after the staple is ejected and the feed pawl 129 engages with a staple-to-staple recess so as to move the staple sheet S forward.

Figure 13B:
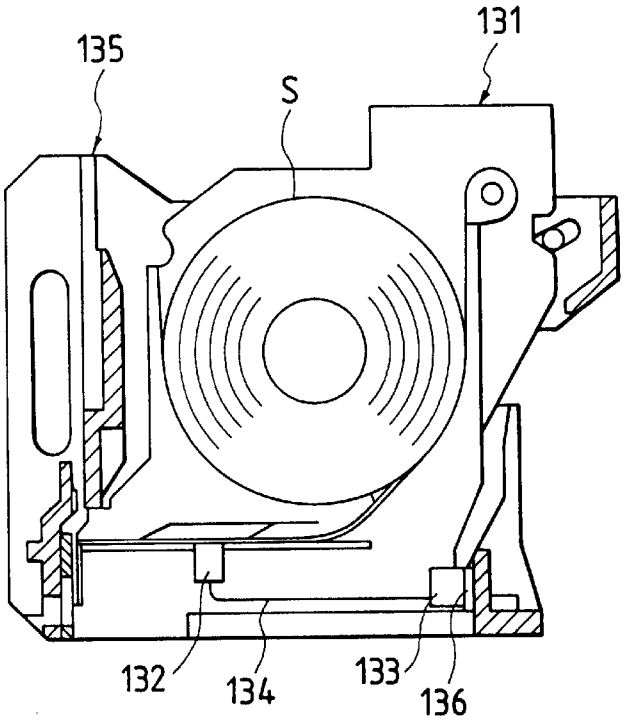
FIGS. 13A and 13B are explanatory views of the state of the staple cartridge before and after the staple detecting unit is loaded with the staple cartridge.
Figure 13A:
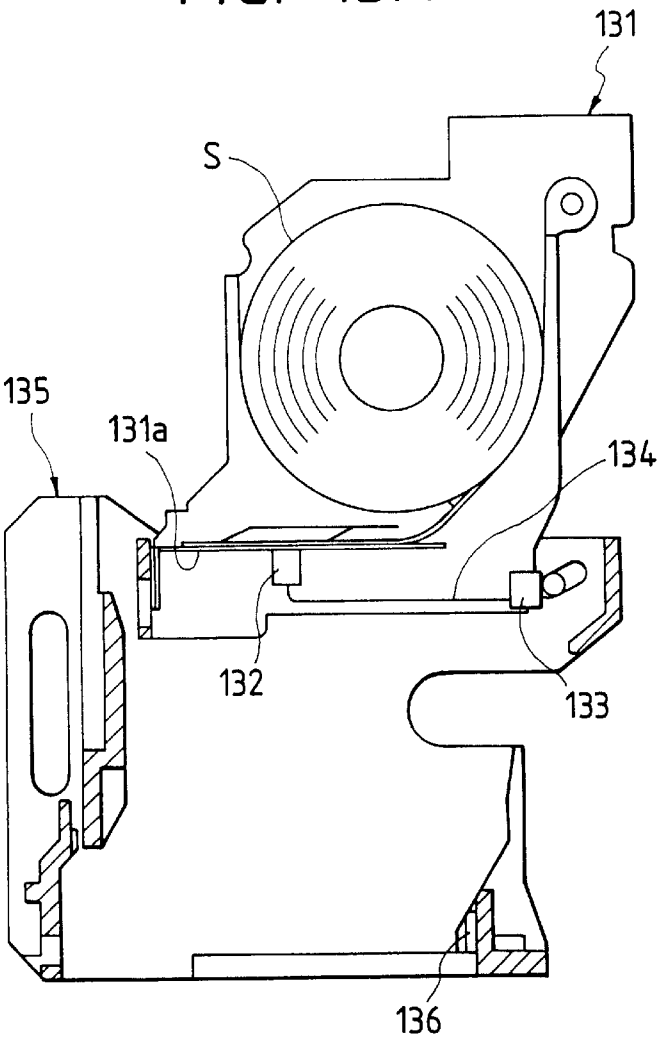

FIGS. 13A and 13B show another staple detecting unit according to the present invention. As shown in FIG. 13A, a photosensor 132 is fitted in the hole provided in a staple guide 131*a* in a staple cartridge 131, and an external contact 133 provided in the lower back portion of the staple cartridge 131 is connected to the photosensor 132 and a wire 134.

In the cartridge holder 135, the circuit contact 136 of the drive control circuit is provided in a position where it contacts the external contact 133 of the staple cartridge 131 at the time the staple cartridge is loaded therein. When the staple cartridge 131 is loaded in the cartridge holder 135 as shown in FIG. 13B, the external contact 133 of the staple cartridge and the circuit contact 136 of the cartridge holder are brought into contact with each other, so that the drive control circuit of the electric stapler and the photosensor 132 are connected.

The function of this staple detecting unit is, like what is described with reference to FIG. 10, the output of the photosensor 132 is high when the staple sheet S is within the staple cartridge 131, and the driving motor is ready for starting. When the end of the staple sheet S passes the position of the photosensor 132, further, the output of the photosensor 132 is changed from ON to OFF and the motor becomes prohibited from being started.

Incidentally, the staple detecting sensor may be a magnetic sensor, a contactless sensor or the like or otherwise an actuator in combination with a microswitch may also be applicable; in other words, the present invention is not limited to the above-described embodiment thereof but may be modified in various manners within the technical range thereof and it is needless to say applicable to any modified embodiment thereof.

Figure 15:
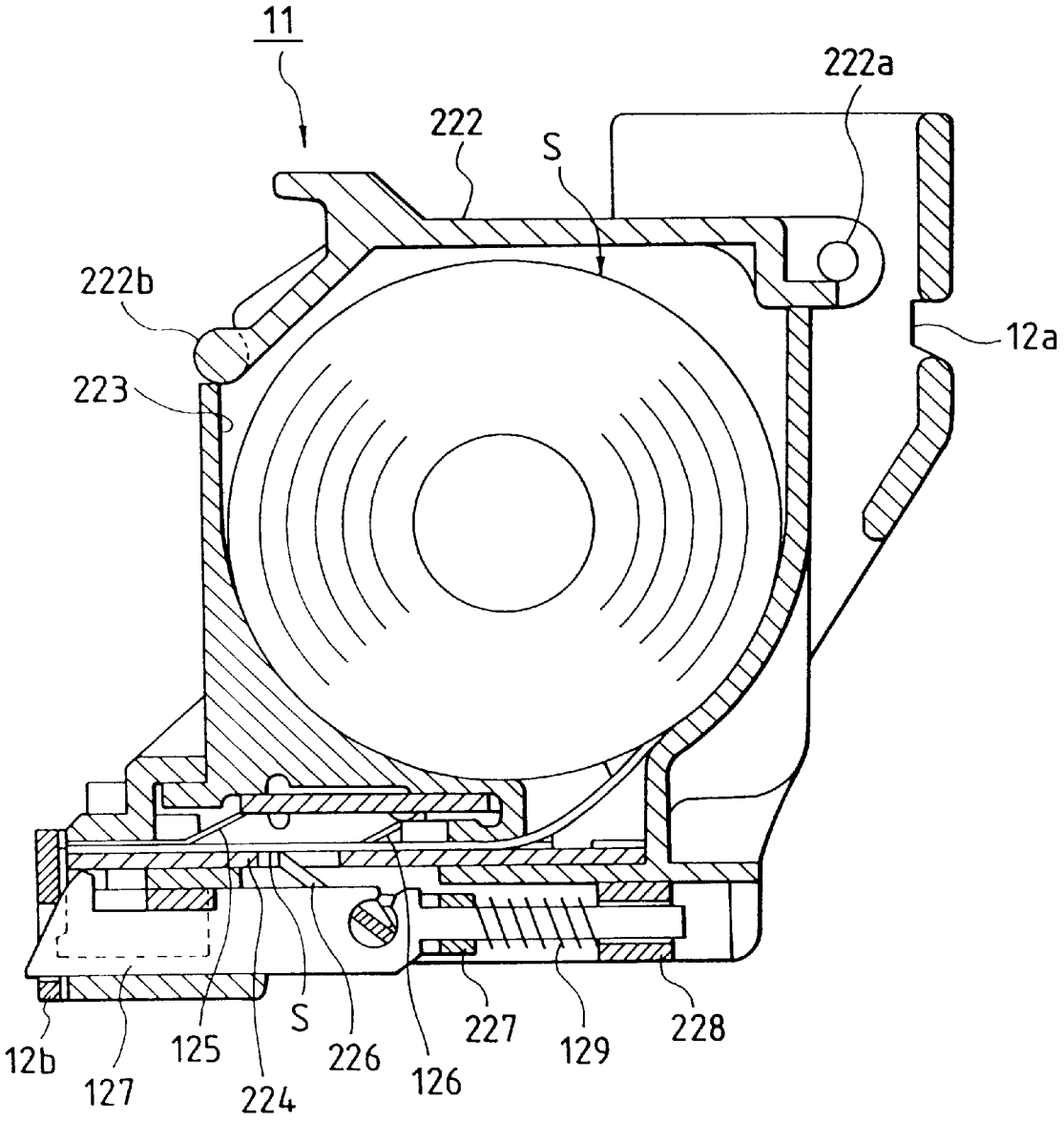
FIG. 15 shows a sectional view of a still further staple cartridge according to the present invention.

As shown in FIG. 15, an upper closing cover 222 is mounted on the staple cartridge 11 via a rear hinge shaft 22*a* and when the cover 222 is closed, a pin 222*b* in the front portion of the upper cover 222 is fitted in a recess in the cartridge body to lock the cover 222. A longitudinal staple guide 224 is provided in the lower portion of a staple containing chamber 223 in the staple cartridge, and a staple feeding plate 127 is longitudinally slidably mounted under the staple guide 224.

The front edge face of the staple feeding plate 127 is tilted from the upper to the lower side and a vertically-turnable feed pawl 226 is pivotally connected to the longitudinal intermediate portion of the staple feeding plate 127. A cylindrical pusher 227 is fitted to the rear portion of the staple feeding plate 127, and a compression spring 129 is stretched between a fixed slide guide portion 228 for supporting the rear end portion of the staple feeding plate 127 and the pusher 227.

As the lower end portion of the feed pawl 226 is pressed down by the pusher 227 urged forward by the compression spring 129, rotational force is applied so that the front portion of the feed pawl 226 is moved up and forced to contact the underside of the staple sheet S and simultaneously the staple feeding plate 127 is urged forward via the pivotal shaft of the feed pawl 226.

Further, a first check pawl 125 and a second check pawl 126 are respectively positioned in front and In the rear of the feed pawl 226 above the staple guide 224, a space being provided longitudinally between the first and second check pawls. The first and second check pawls 125,126 are plate springs mating with the surface of the staple sheet S block the staple sheet from moving back.

Figure 16:
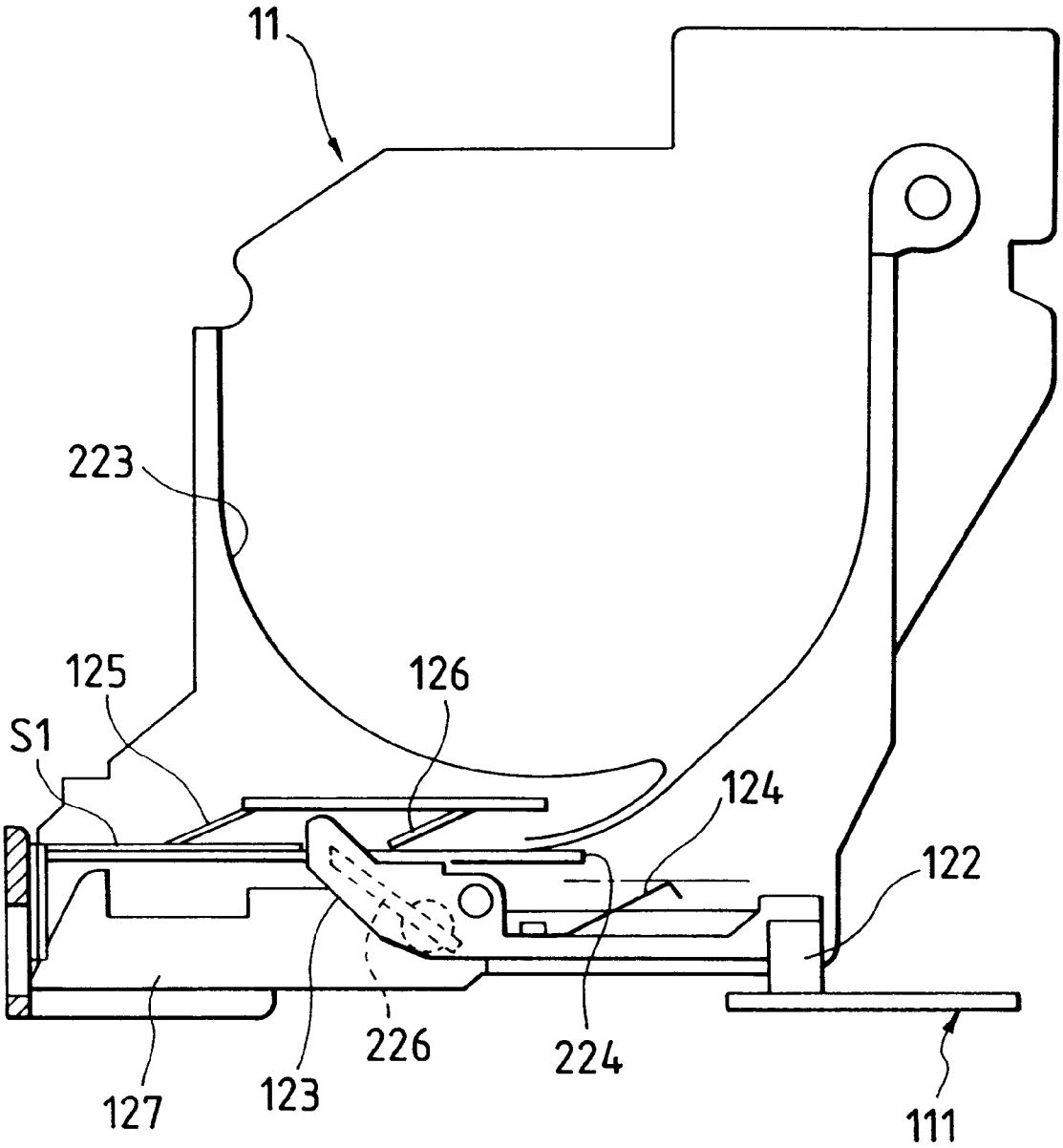
FIG. 16 shows the staple cartridge explanatory of such a state that staples have totally been consumed.
Figure 17:
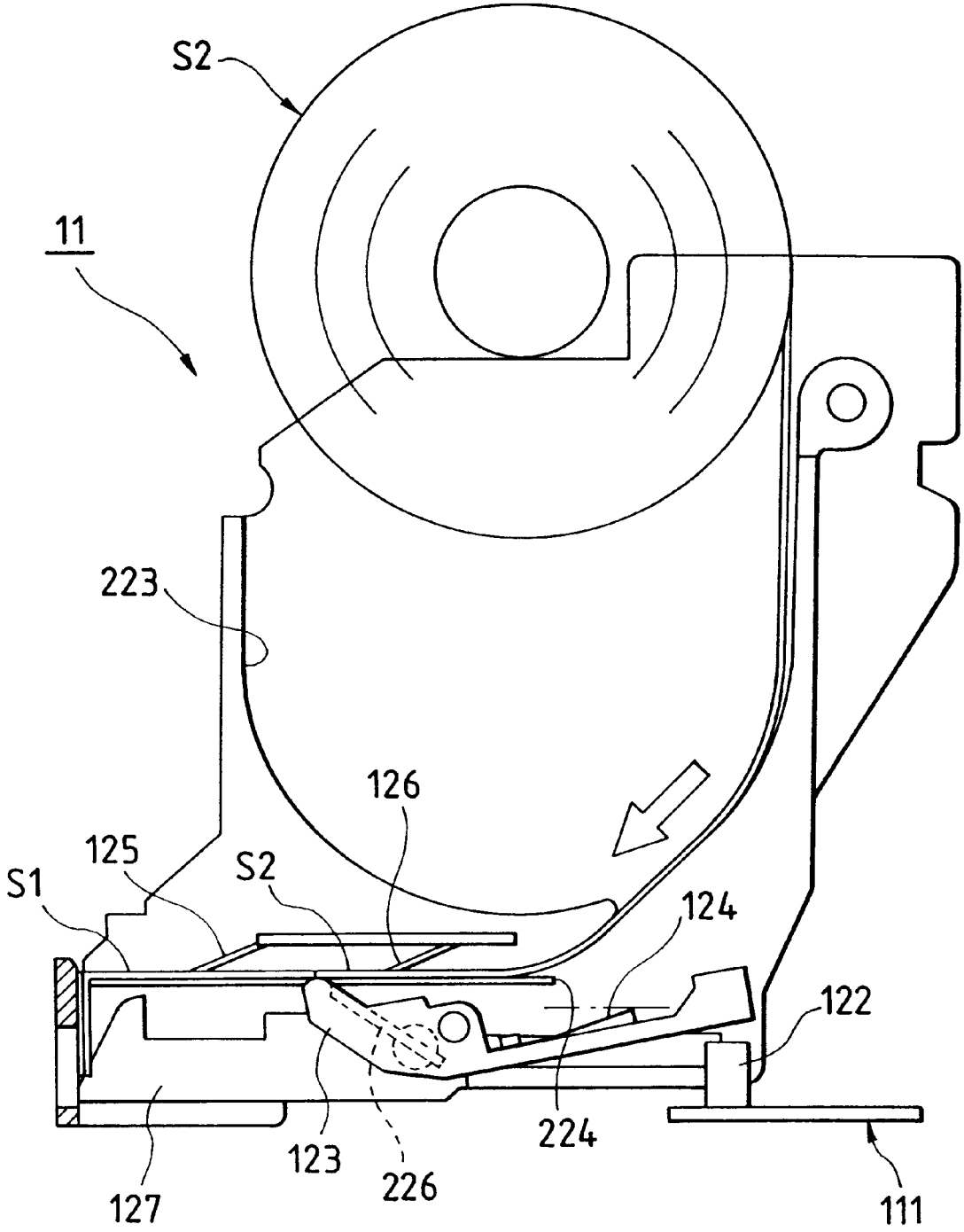
FIG. 17 shows the staple cartridge explanatory of such a state that it is replenished with staples.

As shown in FIGS. 16 and 17, the staple cartridge 11 is fitted with an actuator 123 for detecting staples, the actuator 123 being disposed in parallel to the staple feeding plate 127 and the feed pawl 226. A photointerrupter 122 mounted in the cartridge holder 111 is turned on and off by means of the rear portion of the actuator 123.

When the rear end portion of the staple sheet S is fed forward by the feed pawl 226, the actuator 123 is urged by the plate spring 129 so that its front portion turns to move up while the rear portion blocks the light path in order to switch the drive control circuit to the start suspension state. As described above, the upper cover 222 of the staple cartridge 11 is then opened and the front-end portion of a new roll-type staple sheet is inserted in the staple guide 224. As shown in FIG. 17, further, the front-end portion of the newly supplied staple sheet S2 is brought into contact with the rear end portion of the staple sheet S1 staying in the staple guide 224 so as to engage the second check pawl 126 with the staple sheet S2. At this time, the actuator 123 is turned counterclockwise as it is pushed by the staple sheet S2 and its rear portion is released from the light path of the photointerrupter 122.

When the electric stapler is then started, the feed pawl 226 engages with the front-end portion of the newly supplied staple sheet S2, so that the remaining staple sheet S1 and the newly supplied staple sheet S2 are integrally fed forward.

Figure 18:
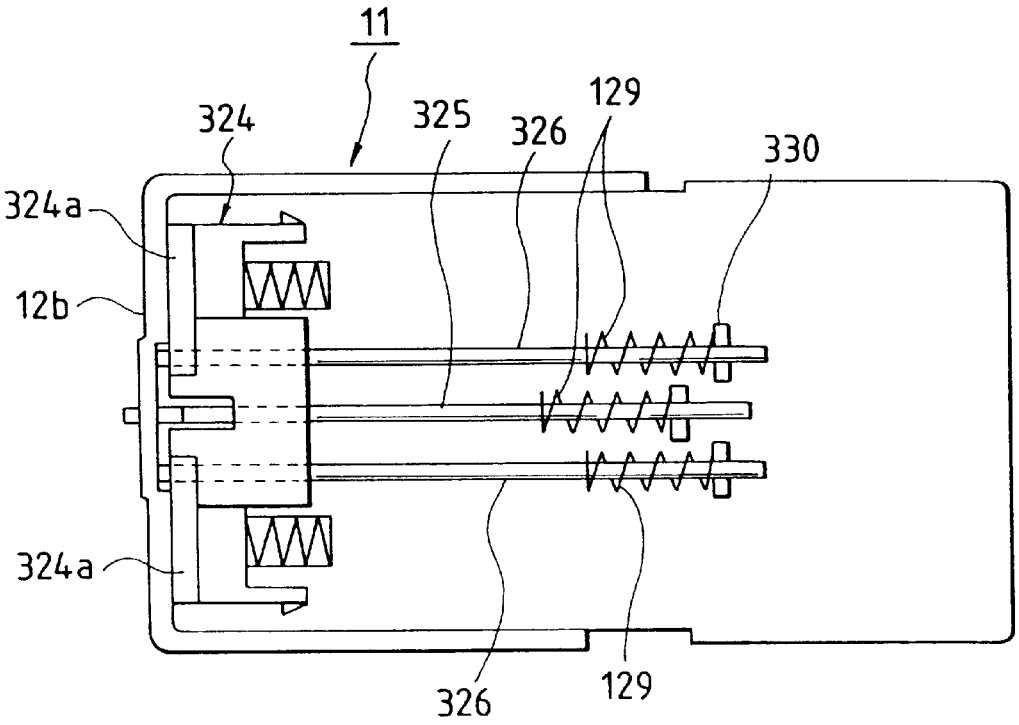
FIG. 18 is a sectional view of a staple support unit according to the present invention.

As shown in FIG. 18, the front edge face of the staple feeding plate 325 is tilted from the upper to the lower side and a vertically-turnable feed pawl 328 is pivotally connected to the longitudinal intermediate portion of the staple feeding plate 325. A cylindrical feed-pawl pusher 329 is fitted to the rear portion of the staple feeding plate 325, and the compression spring 129 is stretched between a fixed slide guide portion 330 for supporting the rear end portion of the staple feeding plate 325 and the feed-pawl pusher 329.

As the lower end portion of the feed pawl 328 is pressed down by the feed-pawl pusher 329 urged forward by the compression spring 129, rotational force is applied so that the front portion of the feed pawl 328 is moved up and forced to contact the underside of a staple sheet S. Simultaneously the staple feeding plate 325 is urged forward via the pivotal shaft of the feed pawl 328.

Further, a first check pawl 125 and a second check pawl 126 are respectively positioned in front and in the rear of the feed pawl 328 above the staple guide 323, a space being provided longitudinally between the first and second check pawls. The first and second check pawls 125, 126 are plate springs mating with the surface of the staple sheet S and block the staple sheet from moving back.

When the driver 13 is moved down after the electric stapler is started, the driver 13 and the staple struck thereby are brought into contact with the front-end tilted surface of the staple feeding plate 325 and move back the staple feeding plate 325. The feed pawl 238 then moves back while sliding on the back of the staple sheet S held by the first and second check pawls 125, 126 in such a way that it is blocked thereby from moving back. Subsequently, the feed pawl 328 together with the staple feeding plate 325 are moved forward when the driver 13 moves up after the staple is ejected and the feed pawl 328 engages with a staple-to-staple recess so as to move the staple sheet S forward.

Figure 19:
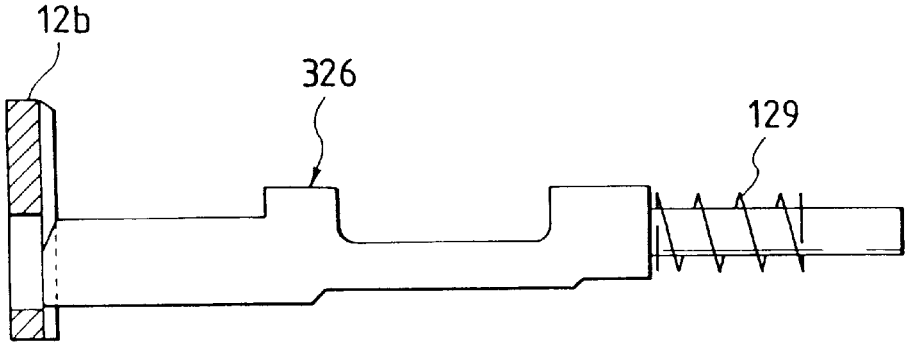
FIG. 19 is a side view of a staple support plate of the staple support unit.

FIG. 19 shows the staple support plate 326 whose upper edge portion on the front edge face is chamfered. Like the staple feeding plate 325, the staple support plate 326 is pressed by the staple struck by the driver 13, moved back when the staple is driven-in and projected forward as the driver 13 moves up.

FIGS. 20A to 22B show the timing of the sliding of the staple pusher 324 and the staple support plates 326. In the standby state shown in FIGS. 20A and 20B, the staple support plates 326 are brought into contact with the lower inner sides of both lateral legs of a first staple S1 and a staple S2 on a second row that have been subjected to forming, and the staples thus subjected to forming are clamped between a front-end plate 12*b* and the staple pusher 324.

Figure 20A:
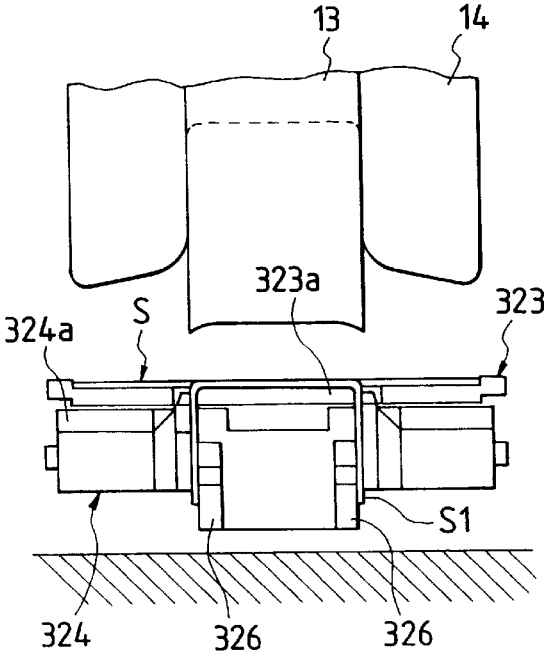
FIGS. 20A and 20B are elevational and side views of a staple drive-in stroke at an initial stage.
Figure 20B:
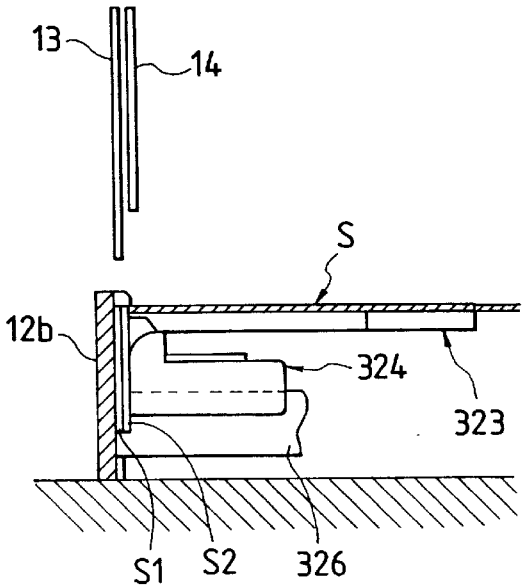
Figure 21A:
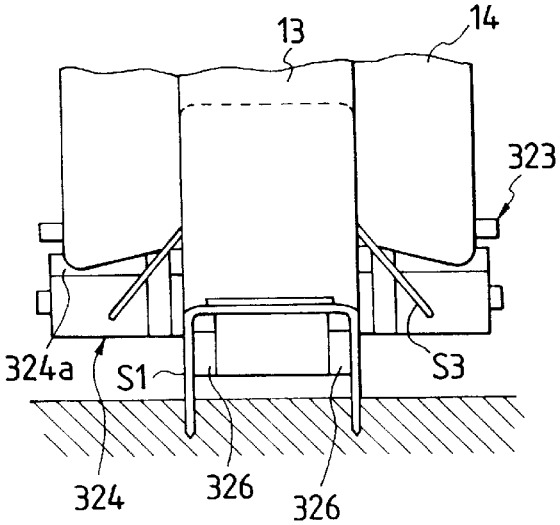
FIGS. 21A and 21B are elevational and side views of an intermediate stroke subsequent to FIGS. 20A and 20B.
Figure 21B:
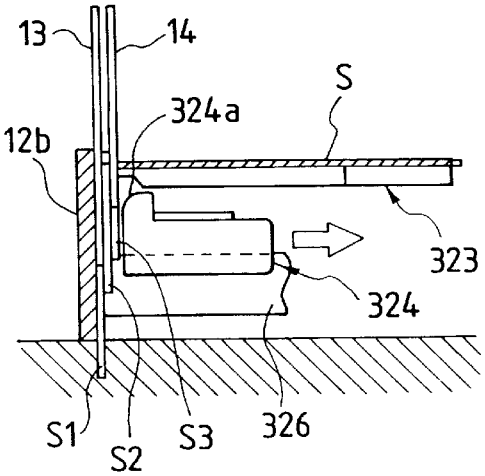

As shown in FIGS. 21A and 21B, the driver 13 and the forming plate 14 are moved down and simultaneously when the first staple S1 is struck by the driver and starts penetrating into an object, both lateral sides of a liner staple S3 on a third row is pressed down by the forming plate 14 and bent along both the lateral sidewalls of a protrusion 323*a* of the staple guide 323 as shown in FIG. 20A. Further, the forming plate 14 presses the chamfered upper edge portion 324*a* of the staple pusher 324 so as to move back the staple pusher 324. However, both legs of the staple Si that is ejected are still being guided by the staple support plates 326 at this point of time without the possibility of inclining the posture of the staple S1.

Figure 22A:
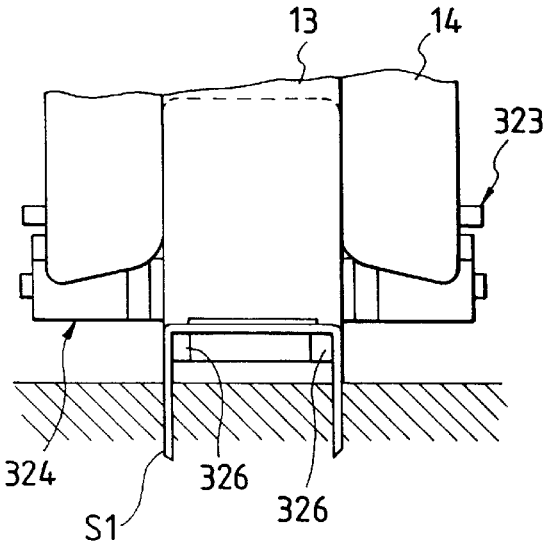
FIGS. 22A and 22B are elevational and side views of an intermediate stroke subsequent to FIGS. 21A and 21B.
Figure 22B:
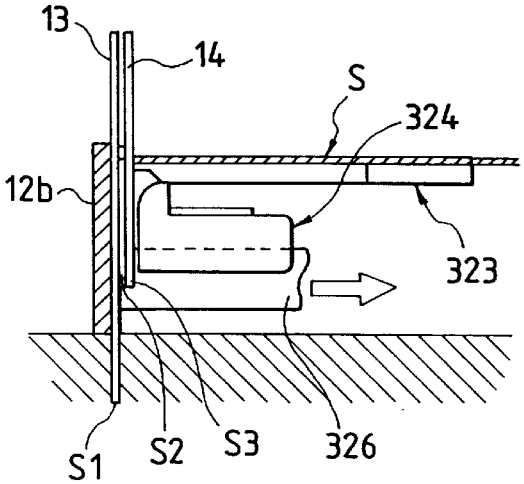
Figure 23A:
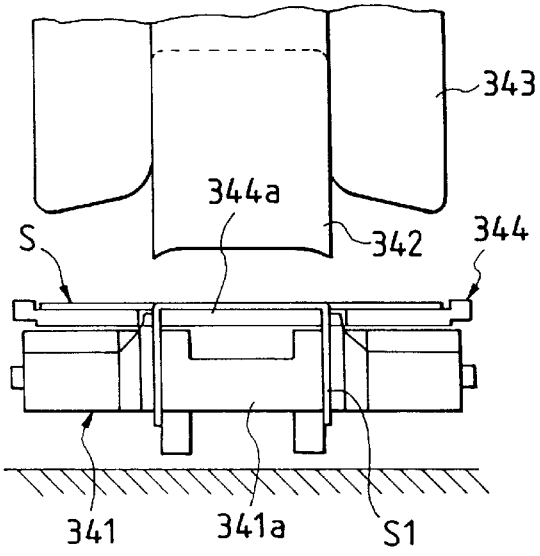
PRIOR ART FIG. 23A
FIGS. 23A and 23B are elevational and side views of a conventional staple support unit with reference to the initial state of a staple drive-in stroke.
Figure 23B:
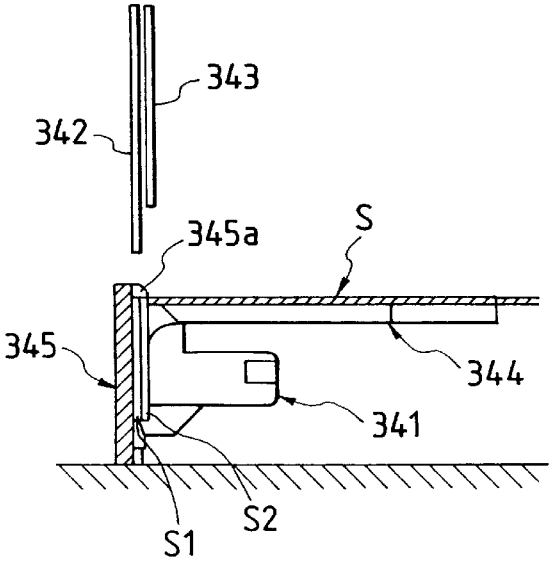
PRIOR ART FIG. 23B
Figure 24A:
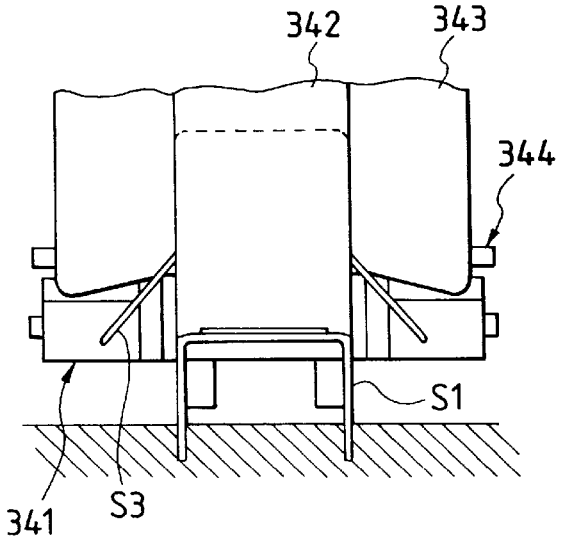
PRIOR ART FIG. 24A
FIGS. 24A and 24B are elevational and side views of the conventional staple support unit subsequent to FIGS. 23A and 23B.
Figure 24B:
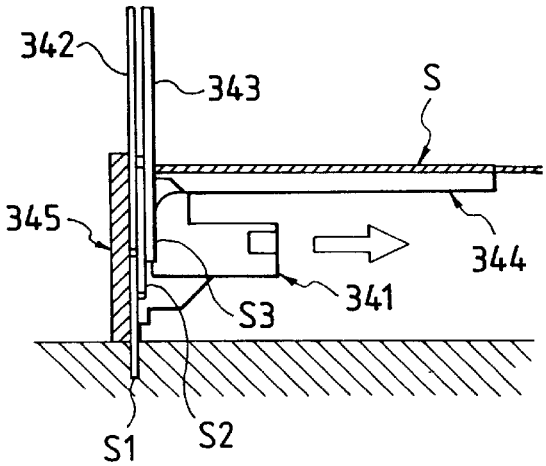
PRIOR ART FIG. 24B
Figure 25A:
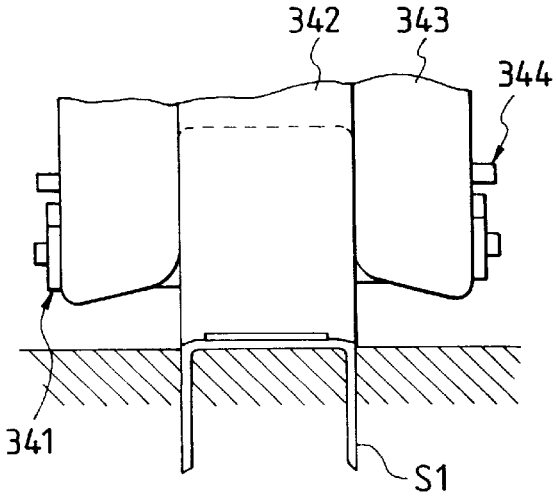
PRIOR ART FIG. 25A
FIGS. 25A and 25B are elevational and side views of the conventional staple support unit subsequent to FIGS. 24A and 24B.
Figure 25B:
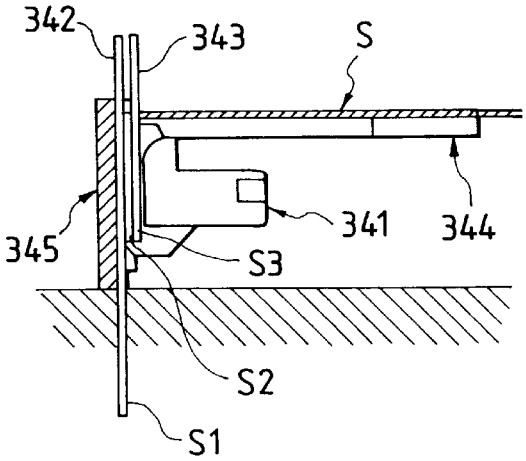
PRIOR ART FIG. 25B

As shown in FIGS. 22A and 22B, further, the upper portion of the staple S1 is brought into contact with the front chamfered portion of the staple support plates 326 so as to press the staple support plates 326 backward immediately before the driver 13 reaches the lowest point after the legs of the staple S1 is almost completely driven into the object.

Since the forming plate 14 and the driver 13 respectively make the staple pusher 324 and the staple support plates 326 slide, the upright posture can be held by the staple support plates 326 just until the staple is completely ejected, regardless of the timing of forming.

Although a description has been given of the case where the staple pusher 324 and the staple support plates 326 are provided in the staple cartridge 11 according to the above-described embodiment of the invention, the present invention is not limited to the embodiment thereof but may be such that an electric stapler of the sort that provides a staple pusher for the stapler body is equipped with a staple support plate together with the staple pusher in order to constitute a staple support unit. Moreover, the present invention is not limited to the above-described embodiment thereof but may be modified in various manners within the technical range thereof and is needless to say applicable to any modified embodiment thereof.

Figure 26A:
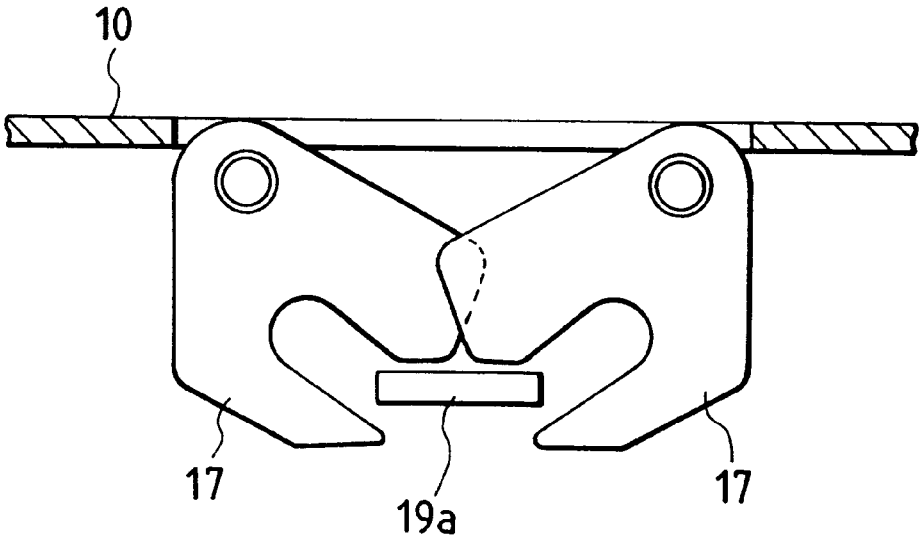
FIGS. 26A and 26B are front views showing the operation of clinchers, more specifically.
Figure 26B:
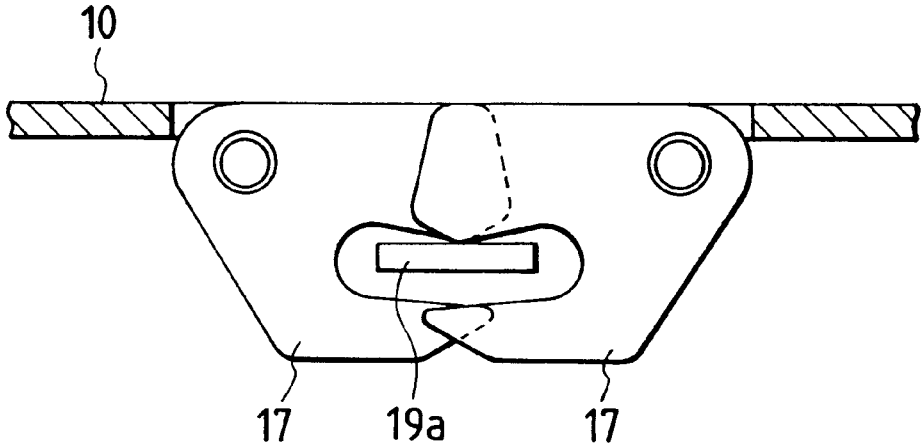

FIGS. 26A and 26B show the operation of the clinchers 18. When the legs of the staple are passed through a slot in the table 10 downward after the staple is driven by the driver 13 into paper on the table 10, the clincher arm 19 is driven by the clincher driving cam and the leading end portion 19*a* in the standby position as shown in FIG. 26A starts ascending. As shown in FIG. 26B then, the leading end portion 19*a* of the clincher arm thrusts up the inner end portions of the clinchers 18 so as to bend the lateral legs of the staple inward.

Figure 27:
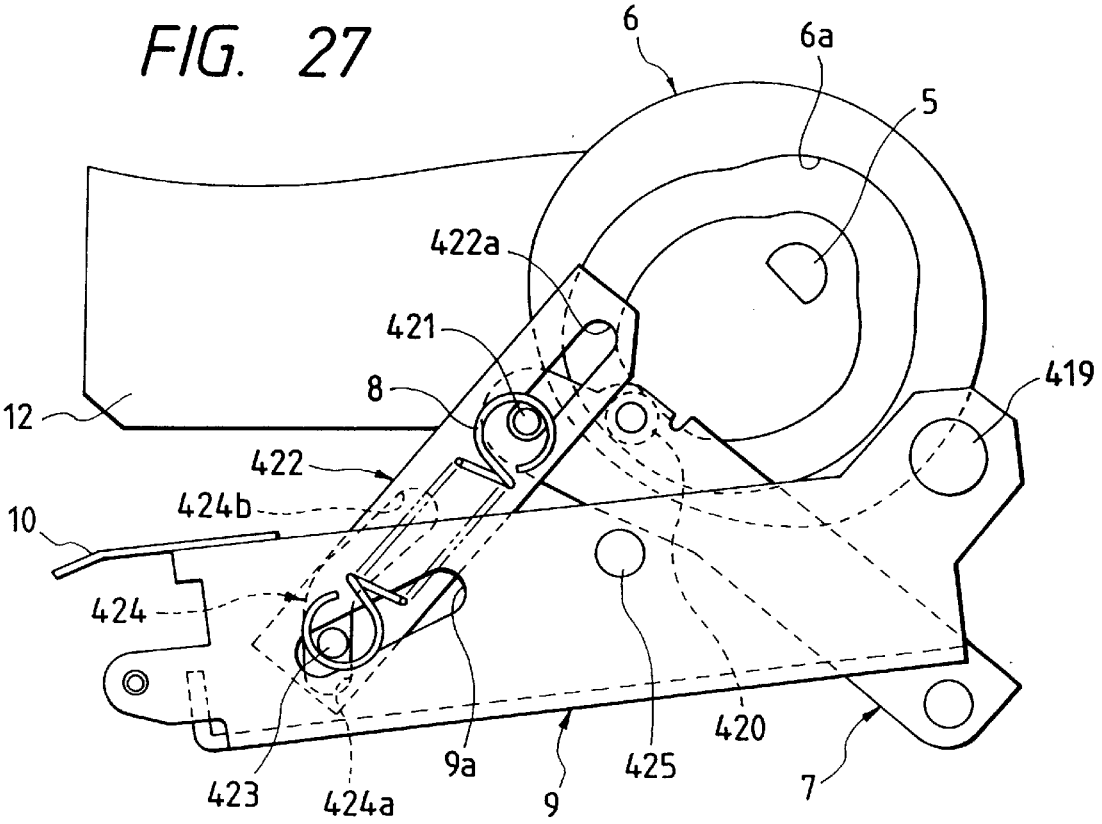
FIG. 27 is a side view of a table hoist mechanism in the standby state.

FIG. 27 shows the table hoist mechanism and for convenience of explanation, there is shown therein a state in which the clincher arm 19 and its driving mechanism have been removed from the table support arm 9. The table support arm 9 is mounted on a shaft 419 provided in the frame 2 and as described above coupled via the extension spring 8 to the table hoist lever 7.

The table hoist lever 7 is pivotally connected to the frame 2, and the roller 420 installed in the intermediate portion of the table hoist lever 7 is mated with the cam groove 6*a* formed in the sidewall of the table driving cam 6 above the table support arm 9. A pin 421 in the leading end portion of the table hoist lever 7 is passed through a slot 422*a* in the rear portion of a pin holder 422.

The extension spring 8 is hooked on a pin 423 secured to the front portion of the pin holder 422 and on the pin 421 of the table hoist lever 7. The pin 421 of the table hoist lever 7 is pulled by the spring force of the extension spring 8 in the direction of the front end of the slot 422*a* of the pin holder 422.

A longitudinal slot 9*a* is formed in the sidewall of the front portion of the table support arm 9, and the pin 423 of the pin holder 422 is passed through a pin guide groove 424 formed in the frame 2 and the slot 9*a* of the table support arm 9. Consequently, the space between the table support arm 9 and the table hoist lever 7 coupled via the extension spring 8 is enlarged when tension stress exceeding the holding force of the extension spring 8 is applied as a load.

The pin guide groove 424 of the frame 2 is constituted of a perpendicular portion 424*a* in the substantially same direction as the rotational direction of the table support arm 9 and a tilted portion 424*b* bending from the upper end of the perpendicular potion 424*a* in the direction of the pin 421 of the table hoist lever 7 and intersecting the slot 9*a* in the front portion of the table support arm 9.

In the standby state shown in FIG. 27, the roller 420 of the table hoist lever 7 is situated in the maximum radial portion of cam groove 6*a* of the table driving cam 6, and the table hoist lever 7 is bent forward. The pin 423 of the pin holder 422 is positioned under the pin guide groove 424, and the table support arm 9 is in the lower standby position.

When a paper detection switch (not shown) is turned on after paper is inserted in between the table 10 and the staple guide 12, the motor 3 is started and the table driving cam 6 starts rotating counterclockwise in FIG. 27. When the roller 420 moves from the bulge of the table driving cam 6 toward its hollow then, the table hoist lever 7 is moved upward from the forward-bent state and the pin 423 in the front portion of the pin holder 422 moves up within the pin guide groove 424 and pushes the table support arm 9 upward.

Figure 28:
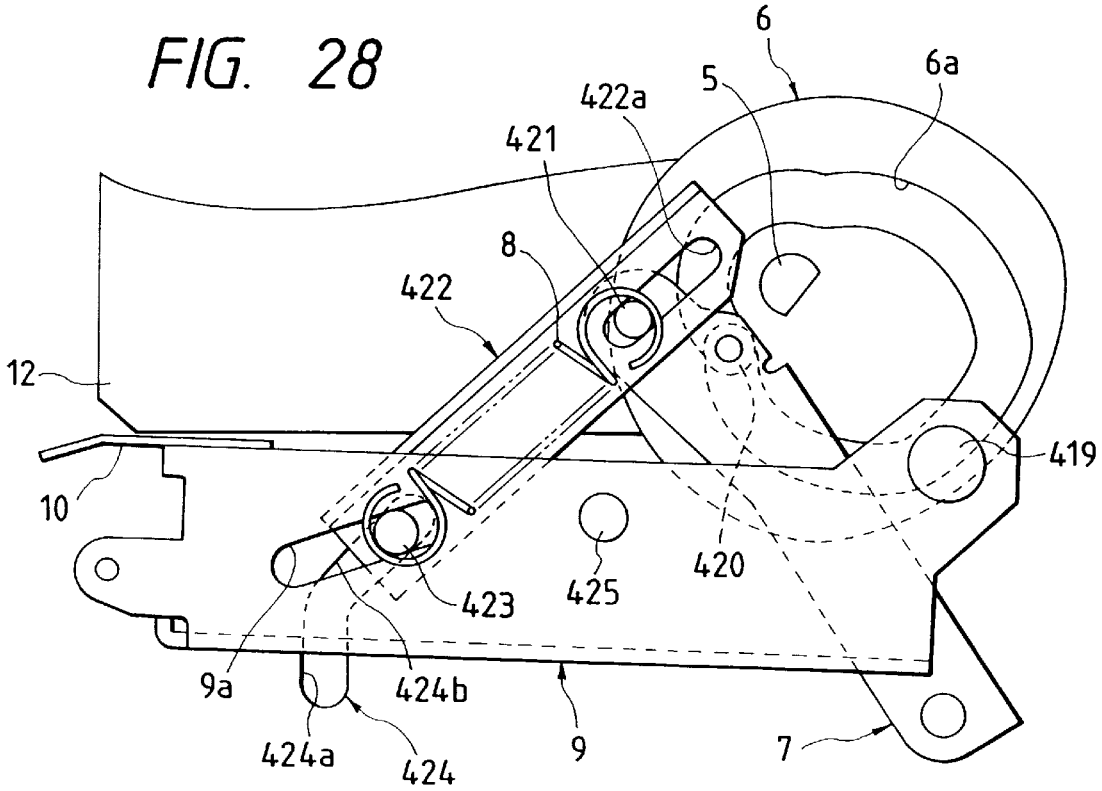
FIG. 28 is a side view of the table hoist mechanism when the table is moved up.

As shown in FIG. 28, the table support arm 9 is brought into contact with paper (not shown) inserted in between the table support arms 9 and the staple guide 12 and then stops moving up. Although the ascent stop position of the table support arm 9 at the time a staple is driven-in varies with the total thickness of the paper, the variation of the distance between the front pin 423 and the rear pin 421 in the ascent stop position thereof is absorbed thereby as tension pressure deriving from the pin 421 of the table hoist lever 7 causes the extension spring 8 to extend.

Subsequently, the roller 420 reaches the minimum radial portion of the table driving cam 6, and the table support arm 9 clamps the paper by means of the spring force of the extension spring 8. Then the operation of the driver is started by a driver driving mechanism (not shown) so as to drive-in the staple and as the table driving cam 6 rotates thereafter, the roller 420 passes over the minimum radial portion of the table driving cam 6 and moves to the bulge portion.

As shown in FIG. 27, the roller 420 then reaches the maximum radial portion of the table driving cam 6 and terminates one-cycle rotation when the table support arm 9 returns the standby position.

In this table driving mechanism, the working radius of table driving cam 6 is maximized when the paper clamping load and the pressure of the driver are applied as the table support arm 9 ascends. The advantage is that the peak value of the rotational load of the motor 3 is low.

Since the tilted portion 424*b* of the pin guide groove 424 is tilted in the direction of the point at which the table hoist lever 7 and the table driving cam 6 mate with respect to the rotational direction of the table support arm 9, the ascending speed of the pin 423 and the table support arm 9 is made lower than the speed of the perpendicular portion 424*a* when the pin 423 of the pin holder 422 moves up from the standby position to the perpendicular portion 424*a* of the pin guide groove 424 and then moves to the tilted portion 424*b* during the ascent stroke of the table support arm 9. Consequently, the rotational torque of the table support arm 9 increases because of the speed reducing action, and simultaneously the paper clamping load applied to the motor 3 is relatively reduced.

Figure 29:
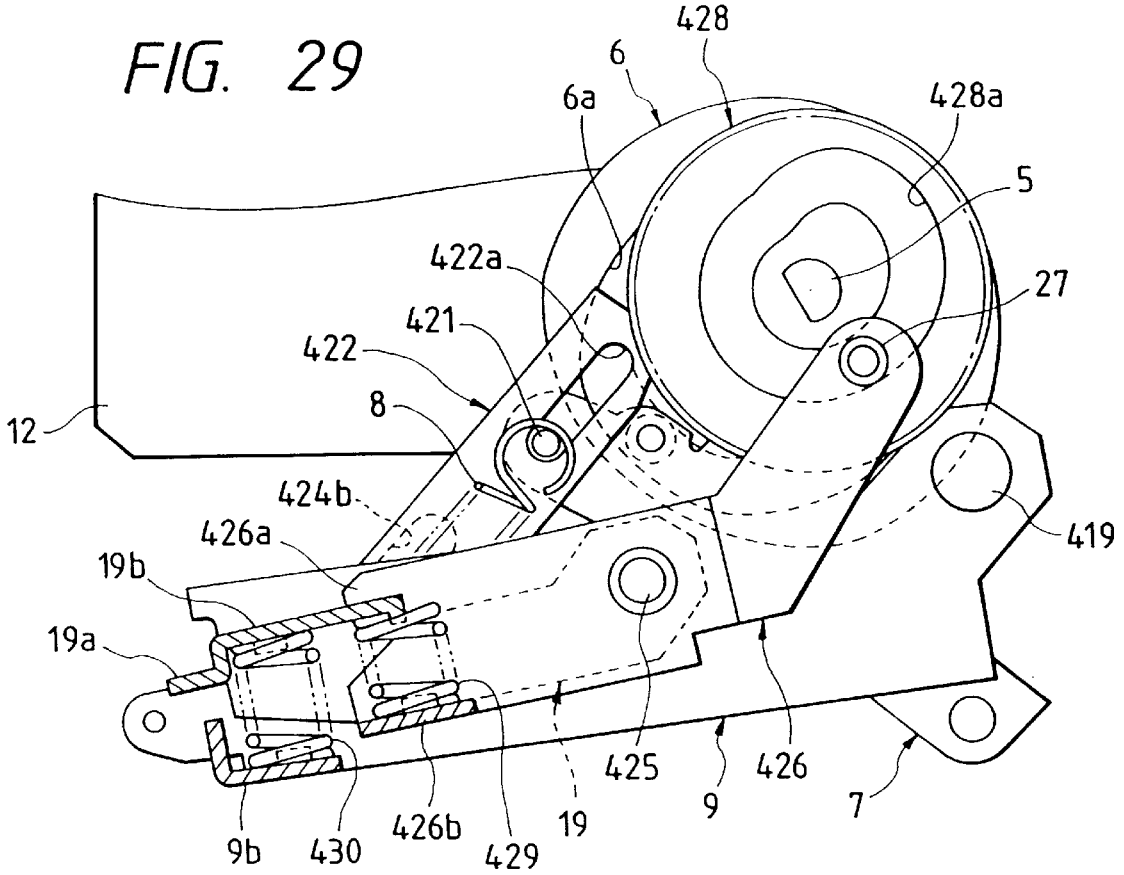
FIG. 29 is a sectional side view of a table hoist and a clincher driving mechanism in the standby state.

FIG. 29 shows the table driving and clincher driving mechanisms in which the clincher arm 19 and a clincher driving lever 426 are mounted on a shaft 425 provided in the longitudinal intermediate region of the table support arm 9. In the front portion of the clincher arm 19, a spring bearing portion 19b is formed and with the leading end portion 19*a* projecting forward further from the spring bearing portion 19*b*, the clinchers 18 are moved up and down.

A roller 27 installed in the rear end portion of the clincher driving lever 426 mates with a cam groove 428*a* in the sidewall of a clincher driving cam 428. A stopper 426*a* projecting forward from both lateral upper sidewalls and a lower bottom plate 426*b* are extended up to the longitudinal intermediate position of the spring bearing portion 19*b* of the clincher arm 19. Further, the spring bearing portion 19*b* of the clincher arm 19 is formed in that it is inserted in between the stopper 426*a* and the bottom plate 426*b*.

Further, a compression spring 429 is stretched between the bottom plate 426*b* of the clincher driving lever 426 and the latter half portion of the spring bearing portion 19*b* of the clincher arm 19 so that the clincher arm 19 is urged upward with respect to the clincher driving lever 426. Further, a compression spring 430 is stretched between the bottom plate 9*b* of the table support arm 9 and the first half portion of the spring bearing portion 19*b* of the clincher arm 19 so that the clincher arm 19 and the clincher driving lever 426 are urged upward.

The clincher driving cam 428 is so formed as to move up the clincher driving lever 426 relatively with respect to the table support arm 9 after the staple is driven by the driver into the paper clamped by the table support arms 9. Moreover, the point at which the roller 427 of the clincher driving lever 426 and the clincher driving cam 428 mate is set closer to the center axis 419 of the table support arm 9, whereby the variation of the relative angle between the table support arm 9 and the clincher driving lever 426 is suppressed during the ascent stroke of the table support arm 9.

FIG. 29 shows a standby state at the same point of time in FIG. 27 wherein the table support arm 9 remains in the descent position and the clincher driving lever 426 is also brought by the clincher driving cam 428 to the descent position relatively with respect to the table support arm 9. The clincher arm 19 is urged by the longitudinal two compression springs 429, 430 upward and the top surface of the spring bearing portion 19*b* is forced to contact the stopper 426*a* of the clincher driving lever 426 and besides the clincher driving lever 426 compresses the front-side compression spring 430 via the clincher arm 19.

As the clincher driving cam 428 turns, the front portion of the clincher driving lever 426 starts moving up after the staple is driven-in, when the clincher arm 19 also moves up integrally with the clincher driving lever 426 while maintaining the ascending state with respect to the clincher driving lever 426 due to the spring force of the longitudinal compression springs 429, 430. Since the upward spring force of the front-side compression spring 430 acts on the clincher driving lever 426, almost no driving load is applied to the clincher driving cam 428.

Figure 30:
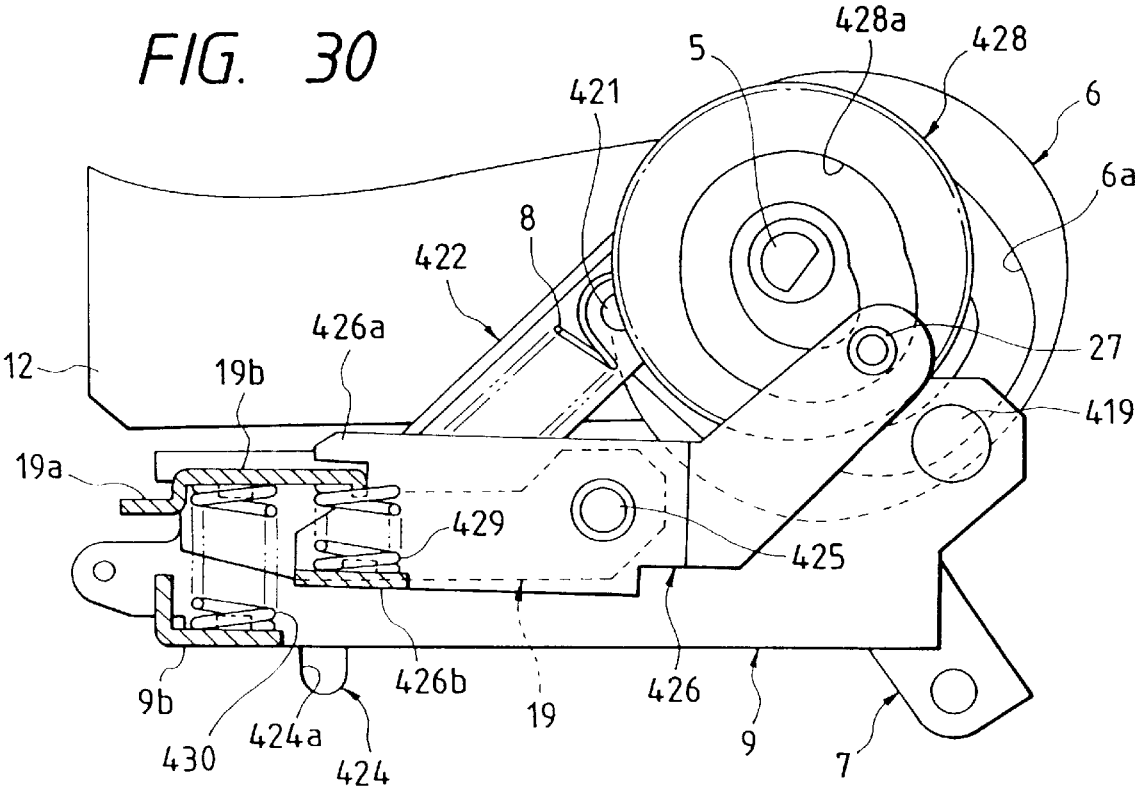
FIG. 30 is a sectional side view of the table hoist and clincher driving mechanisms in a clinching state.

When the leading end portion of the clincher arm 19 is brought into contact with the lower sides of the clinchers 18, the ascent of the clincher arm 19 is obstructed by the bending resistance of the legs of the staple and as shown in FIG. 30, the clincher driving lever 426 driven by the clincher driving cam 428 compresses the rear-side compression spring 429 and is moved up further.

Thus, the synthesized spring force of the longitudinal compression springs 429, 430 acts on the clincher arm 19 and the clinchers 18 and as the rear-side compression spring 429 is compressed, its spring force is increased. When the rotational torque of the clinchers 18 by means of the spring force becomes well over the bend-yield point of the staple, the clinchers 18 are turned to bend the legs of the staple as shown in FIG. 26B.

Subsequently, the table support arm 9 and the clincher driving lever 426 start the descent stroke and the stopper 426*a* at the fore-end of the clincher driving lever 426 is brought into contact with the spring bearing portion 19*b* of the clincher arm 19 and presses the clincher arm 19 downward. While the clincher arm 19 is compressing the front-side compression spring 430, the clincher driving lever 426 and the clincher arm 19 are integrally moved down and return to the standby position of FIG. 29.

The synthesized spring force of the longitudinal two compression springs 429, 430 thus acts on the clinchers 18 when the staple is bent. However, since the rotational load of the clincher driving cam 428 during the ascent stroke of the clincher arm 19 is only the compressive counterforce of the rear-side compression spring 429 in the state shown in FIG. 30, the driving load applied to the motor 3 is halved.

Further, the clincher arm 19 is pivotally fitted to the clincher driving lever 426, and the bending counterforce of the staple transmitted from the clinchers 18 and the clincher arm 19 to the clincher driving lever 426 and the clincher driving cam 428 is so controlled by the compression springs 429, 430 that it is set at a constant value or lower, so that no overload is applied to the driving system.

Since an error in the stroke of the clincher driving lever 426 driven by the cam is absorbed by the compression springs 429, 430, the tolerance of the driving system is prevented from affecting the rotational angles of the clinchers 18, and insufficiency in bending the staple or the application of excessive pressure thereto is also preventable.

Incidentally, the present invention is not limited to the abovedescribed embodiment thereof but may be modified in various manners within the technical range thereof and it is needless to say applicable to any modified embodiment thereof.

As set forth above, the driver unit of the electric stapler according to the present invention is capable of fine adjustment of the vertical position of the driver. Therefore, tolerance of each component part and a positional error due to variation with time can be obviated by adjustment with the effect of not only facilitating assembling and maintenance work but also improving operating accuracy.

As set forth above, the present invention contributes to the stabilization of performance since the positional error due to the tolerance of each component part can be obviated by finely adjusting the longitudinal position of the driver with respect to the clinchers.

As set forth above, since the staple detecting unit of the electric stapler according to the present invention is fitted with the sensor or the actuator of the sensor in the staple cartridge, the variable factor of the positional relation between the staple and the sensor or the actuator in the staple cartridge is reducible in comparison with the conventional electric stapler equipped with a staple detecting means in a cartridge holder and thus operational stability in detecting a staple.

As set forth above, since the staple cartridge of the electric stapler according to the present invention is provided with the check pawl in front and in the rear of the staple feeding pawl, the front and rear staple sheets are held so that they are not movable backward by newly supplying and engaging a staple sheet with the rear check pawl when the staples are used up, whereby staples are continuously supplied by the feed pawl. Thus, the staple cartridge for the feed-pawl type electric stapler is not only repeatedly usable but also contributable to the saving of resources and environment protection.

As set forth above, according to the present invention, the staple support unit which slides separately from the staple pusher is provided, so that the posture of the staple is held by the staple support unit just until the staple is completely ejected. Consequently, unlike the conventional case where a staple is supported with a single integral staple pusher, the possibility of making the staple buckle as its posture is inclined when it is driven-in or causing non-conforming forming is obviated and forming stability is improved

What is claimed is:

1. A staple cartridge for an electric stapler, the staple cartridge being used for supplying linked staples to a driver passage, the staple cartridge comprising:

a staple containing chamber to be replenished with linked staples;

a check pawl for engaging with the linked staples in the staple cartridge in order to block the linked staples from moving back, wherein said check pawl is pivotally mounted to said staple cartridge and resiliently contacts the linked staples;

a staple feeding plate mounted in said staple cartridge for longitudinally reciprocating motion;

a feed pawl pivotally mounted to said staple feeding plate; and a pusher mounted on a rear portion of said staple feeding plate and biased forwardly, wherein said feed pawl is rotated about a pivot point when said pusher presses forwardly on a portion of said feed pawl below said pivot point so that a portion of said feed pawl above said pivot point engages the linked staples.

2. The staple cartridge according to claim 1, wherein the linked staples have a top surface and a bottom surface, said feed pawl bears against said bottom surface and said check pawl bears against said top surface.

3. The staple cartridge according to claim 1, further comprising a plurality of check pawls, wherein said feed pawl contacts said linked staples in a range between said check pawls.

4. The staple cartridge according to claim 1, further comprising a spring and a guide for supporting said rear portion of said staple feeding plate, wherein said spring is mounted between said guide and said pusher for urging said pusher forwardly.

5. The staple cartridge according to claim 1, wherein said check pawl and said feed pawl are plate springs.

6. A staple cartridge for a stapler having a reciprocating driver plate, said cartridge comprising:

a housing coupleable with the stapler in operative relationship with the driver plate;

a staple containing chamber to be replenished with a sheet of linked staples;

a feed plate mounted in said housing for longitudinally reciprocating motion and engageable by the driver plate to reciprocate said feed plate;

a feed pawl mounted to said feed plate and engageable with a sheet of linked staples to feed the staples toward the driver plate when the feed plate is reciprocated;

a check pawl coupled to said housing and disposed to be engageable with the staple sheet to prevent the sheet from moving away from the driver plate; and a pusher mounted on a rear portion of said feed plate and biased forwardly, wherein said feed pawl is rotated about a pivot point when said pusher presses forwardly on a portion of said feed pawl below said pivot point so that a portion of said feed pawl above said pivot point engages the linked staples.

7. The staple cartridge according to claim 6, wherein the linked staples have a top surface and a bottom surface, said feed pawl bears against said bottom surface and said check pawl bears against said top surface.

8. The staple cartridge according to claim 6, further comprising a plurality of check pawls, wherein said feed pawl contacts said linked staples in a range between said check pawls.

9. The staple cartridge according to claim 6, further comprising a spring and a guide for supporting said rear portion of said staple feeding plate, wherein said spring is mounted between said guide and said pusher for urging said pusher forwardly.

10. The staple cartridge according to claim 6, wherein said check pawl and said feed pawl are plate springs.

* * * * *